US008434855B2

(12) United States Patent
Huffman et al.

(10) Patent No.: US 8,434,855 B2
(45) Date of Patent: May 7, 2013

(54) FLUID EJECTOR INCLUDING MEMS COMPOSITE TRANSDUCER

(75) Inventors: James D. Huffman, Pittsford, NY (US); Weibin Zhang, Pittsford, NY (US); John A. Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 98 days.

(21) Appl. No.: 13/089,528

(22) Filed: Apr. 19, 2011

(65) Prior Publication Data

US 2012/0268526 A1 Oct. 25, 2012

(51) Int. Cl.
*B41J 2/04* (2006.01)

(52) U.S. Cl.
USPC ..... 347/54; 347/63; 347/64; 347/65

(58) Field of Classification Search ..... 347/54, 347/70–74, 77, 82, 63–65
See application file for complete search history.

(56) References Cited

U.S. PATENT DOCUMENTS 6,460,972 B1 * 10/2002 Trauernicht et al. ..... 347/54
6,464,347 B2 10/2002 Kneezel et al.
6,474,787 B1 11/2002 Cruz-Uribe
6,561,627 B2 * 5/2003 Jarrold et al. ..... 347/54
7,175,258 B2 2/2007 Cabal et al.
7,350,902 B2 4/2008 Dietl et al.
7,571,992 B2 8/2009 Jia et al.
2004/0090495 A1 5/2004 Delametter et al.
2004/0263574 A1 12/2004 Ishikawa
2006/0132546 A1 6/2006 Gau et al.

* cited by examiner

*Primary Examiner* — Juanita D Jackson
(74) *Attorney, Agent, or Firm* — William R. Zimmerli

(57) ABSTRACT

A fluid ejector includes a substrate, a MEMS transducing member, a compliant membrane, walls, and a nozzle. First portions of the substrate define an outer boundary of a cavity. Second portions of the substrate define a fluidic feed. A first portion of the MEMS transducing member is anchored to the substrate. A second portion of the MEMS transducing member extends over at least a portion of the cavity and is free to move relative to the cavity. The compliant membrane is positioned in contact with the MEMS transducing member. A first portion of the compliant membrane covers the MEMS transducing member. A second portion of the compliant membrane is anchored to the substrate. Partitioning walls define a chamber that is fluidically connected to the fluidic feed. At least the second portion of the MEMS transducing member is enclosed within the chamber. The nozzle is disposed proximate to the second portion of the MEMS transducing member and distal to the fluidic feed.

34 Claims, 19 Drawing Sheets

FLUID EJECTOR INCLUDING MEMS COMPOSITE TRANSDUCER

CROSS REFERENCE TO RELATED APPLICATIONS

Reference is made to commonly-assigned, U.S. patent applications Ser. No. 13/089,541, entitled "MEMS COMPOSITE TRANSDUCER INCLUDING COMPLIANT MEMBRANE", Ser. No. 13/089,532, entitled "FABRICATING MEMS COMPOSITE TRANSDUCER INCLUDING COMPLIANT MEMBRANE", Ser. No. 13/089,542, entitled "FLUID EJECTION USING MEMS COMPOSITE TRANSDUCER", all filed concurrently herewith.

FIELD OF THE INVENTION

This invention relates generally to the field of digitally controlled fluid ejection systems, and in particular to fluid ejectors including a MEMS transducer.

BACKGROUND OF THE INVENTION

Micro-Electro-Mechanical Systems (or MEMS) devices are becoming increasingly prevalent as low-cost, compact devices having a wide range of applications. Uses include pressure sensors, accelerometers, gyroscopes, microphones, digital mirror displays, microfluidic devices, biosensors, chemical sensors, and others. MEMS transducers are typically made using standard thin film and semiconductor processing methods. As new designs, methods and materials are developed, the range of usages and capabilities of MEMS devices can be extended.

MEMS transducers are typically characterized as being anchored to a substrate and extending over a cavity in the substrate. Three general types of such transducers include a) a cantilevered beam having a first end anchored and a second end cantilevered over the cavity; b) a doubly anchored beam having both ends anchored to the substrate on opposite sides of the cavity; and c) a clamped sheet that is anchored around the periphery of the cavity. Type c) is more commonly called a clamped membrane, but the word membrane will be used in a different sense herein, so the term clamped sheet is used to avoid confusion.

Actuators can be used to provide a displacement or a vibration. For example, the amount of deflection δ of the end of a cantilever in response to a stress σ is given by Stoney's formula $$\delta=3\sigma(1-\nu)L^2/Et^2 \quad (1),$$

where v is Poisson's ratio, E is Young's modulus, L is the beam length, and t is the thickness of the cantilevered beam. In order to increase the amount of deflection for a cantilevered beam, one can use a longer beam length, a smaller thickness, a higher stress, a lower Poisson's ratio, or a lower Young's modulus. The resonant frequency of vibration of an undamped cantilevered beam is given by $$f=\omega_0/2\pi=(k/m)^{1/2}/2\pi \quad (2),$$

where k is the spring constant and m is the mass. For a cantilevered beam of constant width w, the spring constant k is given by $$k=Ewt^3/4L^3 \quad (3).$$

It can be shown that the dynamic mass m of an oscillating cantilevered beam is approximately one quarter of the actual mass of ρwtL (ρ being the density of the beam material), so that within a few percent, the resonant frequency of vibration of an undamped cantilevered beam is approximately $$f\sim(t/2\pi L^2)(E/\rho)^{1/2} \quad (4).$$

For a lower resonant frequency one can use a smaller Young's modulus, a smaller thickness, a longer length, or a larger density. A doubly anchored beam typically has a lower amount of deflection and a higher resonant frequency than a cantilevered beam having comparable geometry and materials. A clamped sheet typically has an even lower amount of deflection and an even higher resonant frequency.

Based on material properties and geometries commonly used for MEMS transducers the amount of deflection can be limited, as can the frequency range, so that some types of desired usages are either not available or do not operate with a preferred degree of energy efficiency, spatial compactness, or reliability. In addition, typical MEMS transducers operate independently. For some applications independent operation of MEMS transducers is not able to provide the range of performance desired. Further, typical MEMS transducer designs do not provide a sealed cavity which can be beneficial for some fluidic applications.

A fluid ejector incorporating a MEMS transducer in a fluid chamber ejects a drop through a nozzle by deflecting the MEMS transducer. Typically, conventional fluid ejectors include a cantilevered beam as described in U.S. Pat. No. 6,561,627 or a doubly anchored beam as described in U.S. Pat. No. 7,175,258. The amount of fluid that can be ejected by conventional fluid ejectors is related to the amount of displacement of the MEMS transducer.

Accordingly, there is an ongoing need to provide a fluid ejector that includes a MEMS transducer design and method of operation that facilitates low cost fluid ejecting devices having improved volumetric displacement, provides an ejection force increases spatial compactness of an array of fluid ejectors, or increases ejector compatibility with fluids having different fluid properties.

In a fluid ejector that includes a mechanical actuator, for example, a conventional piezoelectric actuator, standing waves can be undesirably set up in the substrate, which interferes with reliable fluid ejection. Accordingly, there is an ongoing need to provide a fluid ejector actuator that causes less vibrational energy to be coupled into the substrate.

Fluid ejectors are also used in conventional inkjet printing applications. In drop-on-demand inkjet printing ink drops are typically ejected onto a print medium using a pressurization actuator (thermal or piezoelectric, for example). Selective activation of the actuator causes the formation and ejection of a flying ink drop that crosses the space between the printhead and the print medium and strikes the print medium. The formation of printed images is achieved by controlling the individual formation of ink drops, as is required to create the desired image. Motion of the print medium relative to the printhead can consist of keeping the printhead stationary and advancing the print medium past the printhead while the drops are ejected. This architecture is appropriate if the nozzle array on the printhead can address the entire region of interest across the width of the print medium. Such printheads are sometimes called pagewidth printheads.

A second type of printer architecture is the carriage printer, where the printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a carriage scan direction that is substantially perpendicular to the print medium advance direction as the drops are ejected from the nozzles. After the carriage has printed a swath of the image while traversing the print medium, the print medium is advanced, the carriage direction of motion is reversed, and the image is formed swath by swath.

For either page-width printers or carriage printers, there is an ongoing need to provide a printhead having arrays of large numbers of fluid ejectors arranged in a relatively small space. Accordingly, there is also an ongoing need to provide a fluid ejector that is spatially compact and is capable of ejecting a drop a required size, and that provides sufficient force at an appropriate operating frequency to eject high viscosity inks, such as nonaqueous inks. Additionally, for ejecting some types of inks, there is an ongoing need to provide a fluid ejecting mechanism that does not impart excessive heat into the inks (that in some instances also requiring subsequent cooling) so as to increase ink compatibility and facilitate increased drop ejection frequency.

In addition to conventional printing applications, fluid ejectors can be used for ejection of other types of materials. For ejecting materials that can be damaged by excessive heat, there is an ongoing need to provide a fluid ejector that does not apply excessive heat to the fluid being ejected so as to minimizes the likelihood of properties of the fluid changing during drop ejection.

SUMMARY OF THE INVENTION

According to one aspect of the invention, a fluid ejector includes a substrate, a MEMS transducing member, a compliant membrane, walls, and a nozzle. First portions of the substrate define an outer boundary of a cavity. Second portions of the substrate define a fluidic feed. A first portion of the MEMS transducing member is anchored to the substrate. A second portion of the MEMS transducing member extends over at least a portion of the cavity and is free to move relative to the cavity. The compliant membrane is positioned in contact with the MEMS transducing member. A first portion of the compliant membrane covers the MEMS transducing member. A second portion of the compliant membrane is anchored to the substrate. Partitioning walls define a chamber that is fluidically connected to the fluidic feed. At least the second portion of the MEMS transducing member is enclosed within the chamber. The nozzle is disposed proximate to the second portion of the MEMS transducing member and distal to the fluidic feed.

According to another aspect of the invention, an inkjet printhead includes a fluid ejector. The fluid ejector includes a substrate, a MEMS transducing member, a compliant membrane, walls, and a nozzle. First portions of the substrate define an outer boundary of a cavity. Second portions of the substrate define a fluidic feed. A first portion of the MEMS transducing member is anchored to the substrate. A second portion of the MEMS transducing member extends over at least a portion of the cavity and is free to move relative to the cavity. The compliant membrane is positioned in contact with the MEMS transducing member. A first portion of the compliant membrane covers the MEMS transducing member. A second portion of the compliant membrane is anchored to the substrate. Partitioning walls define a chamber that is fluidically connected to the fluidic feed. At least the second portion of the MEMS transducing member is enclosed within the chamber. The nozzle is disposed proximate to the second portion of the MEMS transducing member and distal to the fluidic feed. A mounting member includes an ink passageway that is fluidically connected to the fluidic feed. A sealing member is configured to seal around the fluidic feed and the ink passageway.

According to another aspect of the invention, an inkjet printer includes a media advance region and an inkjet printhead. The media advance region includes an input region, a printing region and an output region. The inkjet printhead includes a fluid ejector. The fluid ejector includes a substrate, a MEMS transducing member, a compliant membrane, walls, and a nozzle. First portions of the substrate define an outer boundary of a cavity. Second portions of the substrate define a fluidic feed. A first portion of the MEMS transducing member is anchored to the substrate. A second portion of the MEMS transducing member extends over at least a portion of the cavity and is free to move relative to the cavity. The compliant membrane is positioned in contact with the MEMS transducing member. A first portion of the compliant membrane covers the MEMS transducing member. A second portion of the compliant membrane is anchored to the substrate. Partitioning walls define a chamber that is fluidically connected to the fluidic feed. At least the second portion of the MEMS transducing member is enclosed within the chamber. The nozzle is disposed proximate to the second portion of the MEMS transducing member and distal to the fluidic feed. A mounting member includes an ink passageway that is fluidically connected to the fluidic feed. A sealing member is configured to seal around the fluidic feed and the ink passageway. A fluid supply is fluidically connected to the ink passageway of the mounting member. A controller is configured to control the ejection of drops of fluid from the fluid ejector onto a portion of media disposed in the printing region of the media advance region.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Embodiments of the present invention include a variety of types of fluid ejectors incorporating MEMS transducers including a MEMS transducing member and a compliant membrane positioned in contact with the MEMS transducing member. It is to be noted that in some definitions of MEMS structures, MEMS components are specified to be between 1 micron and 100 microns in size. Although such dimensions characterize a number of embodiments, it is contemplated that some embodiments will include dimensions outside that range. Typically, the fluid ejectors of the present invention eject liquid, in the form of drops, when a liquid drop is desired.

Figure 1A:
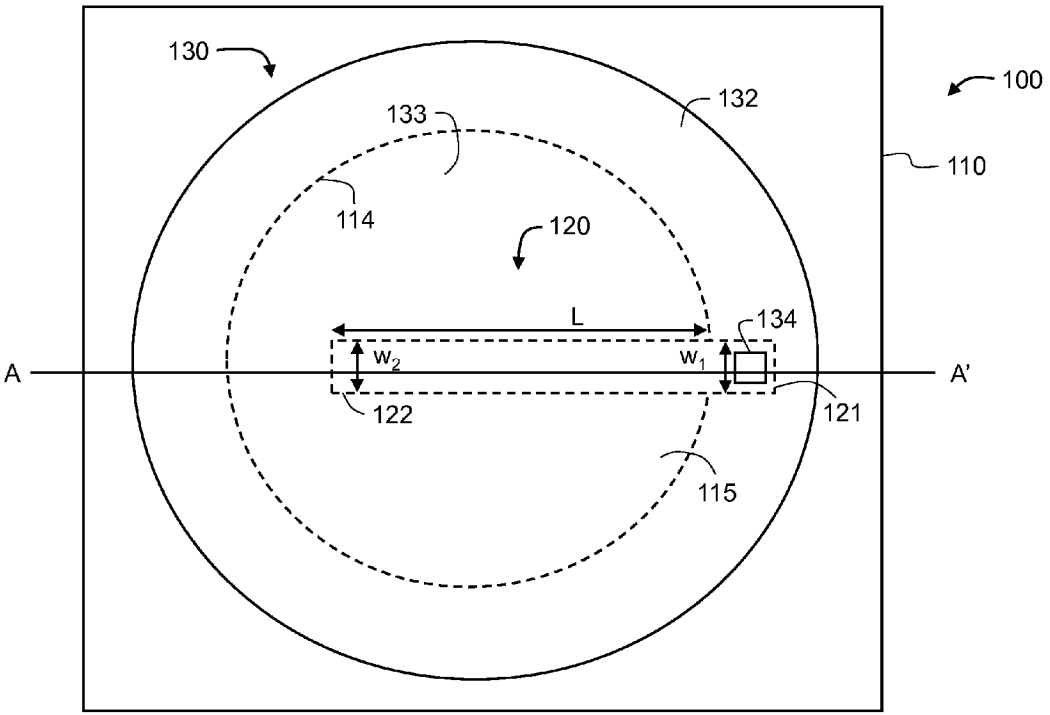
FIG. 1A is a top view and FIG. 1B is a cross-sectional view of an embodiment of a MEMS composite transducer including a cantilevered beam and a compliant membrane over a cavity.
Figure 1B:
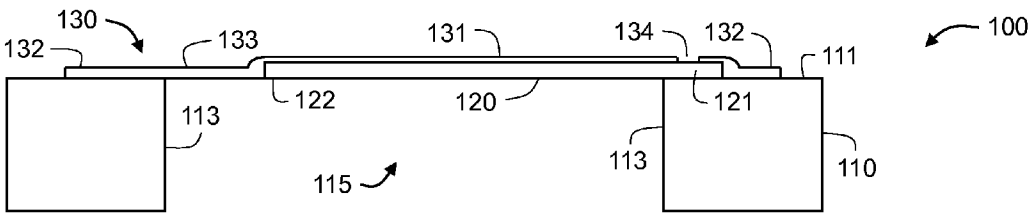

FIG. 1A shows a top view and FIG. 1B shows a cross-sectional view (along A-A') of a first embodiment of a MEMS composite transducer 100, where the MEMS transducing member is a cantilevered beam 120 that is anchored at a first end 121 to a first surface 111 of a substrate 110. Portions 113 of the substrate 110 define an outer boundary 114 of a cavity 115. In the example of FIGS. 1A and 1B, the cavity 115 is substantially cylindrical and is a through hole that extends from a first surface 111 of substrate 110 (to which a portion of the MEMS transducing member is anchored) to a second surface 112 that is opposite first surface 111. Other shapes of cavity 115 are contemplated for other embodiments in which the cavity 115 does not extend all the way to the second surface 112. Still other embodiments are contemplated where the cavity shape is not cylindrical with circular symmetry. A portion of cantilevered beam 120 extends over a portion of cavity 115 and terminates at second end 122. The length L of the cantilevered beam extends from the anchored end 121 to the free end 122. Cantilevered beam 120 has a width $w_1$ at first end 121 and a width $w_2$ at second end 122. In the example of FIGS. 1A and 1B, $w_1=w_2$, but in other embodiments described below that is not the case.

MEMS transducers having an anchored beam cantilevering over a cavity are well known. A feature that distinguishes the MEMS composite transducer 100 from conventional devices is a compliant membrane 130 that is positioned in contact with the cantilevered beam 120 (one example of a MEMS transducing member). Compliant membrane includes a first portion 131 that covers the MEMS transducing member, a second portion 132 that is anchored to first surface 111 of substrate 110, and a third portion 133 that overhangs cavity 115 while not contacting the MEMS transducing member. In a fourth region 134, compliant membrane 130 is removed such that it does not cover a portion of the MEMS transducing member near the first end 121 of cantilevered beam 120, so that electrical contact can be made as is discussed in further detail below. In the example shown in FIG. 1B, second portion 132 of compliant membrane 130 that is anchored to substrate 110 is anchored around the outer boundary 114 of cavity 115. In other embodiments, it is contemplated that the second portion 132 does not extend entirely around outer boundary 114.

Figure 2:
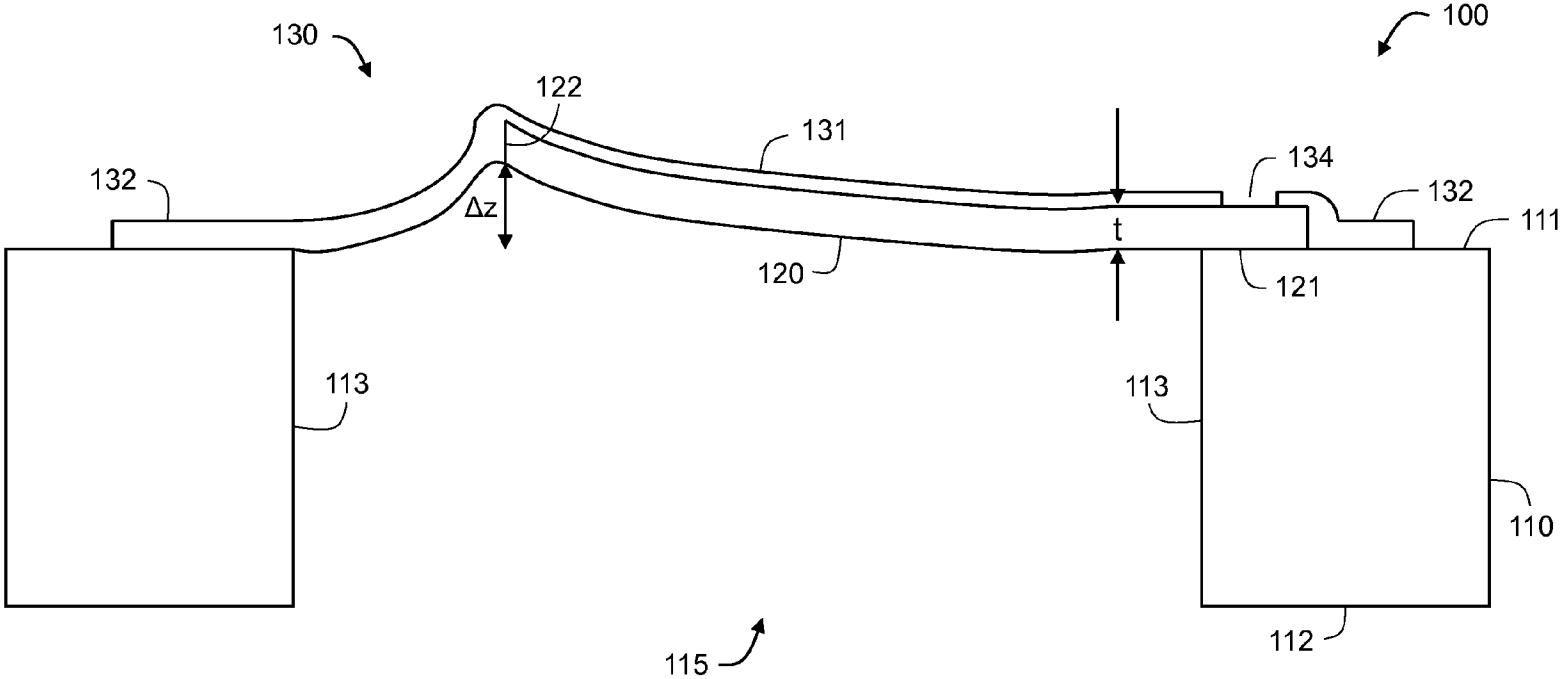
FIG. 2 is a cross-sectional view similar to FIG. 1B, where the cantilevered beam is deflected.

The portion (including end 122) of the cantilevered beam 120 that extends over at least a portion of cavity 115 is free to move relative to cavity 115. A common type of motion for a cantilevered beam is shown in FIG. 2, which is similar to the view of FIG. 1B at higher magnification, but with the cantilevered portion of cantilevered beam 120 deflected upward away by a deflection $\delta=\Delta z$ from the original undeflected position shown in FIG. 1B (the z direction being perpendicular to the x-y plane of the surface 111 of substrate 110). Such a bending motion is provided for example in an actuating mode by a MEMS transducing material (such as a piezoelectric material, or a shape memory alloy, or a thermal bimorph material) that expands or contracts relative to a reference material layer to which it is affixed when an electrical signal is applied, as is discussed in further detail below. When the upward deflection out of the cavity is released (by stopping the electrical signal), the MEMS transducer typically moves from being out of the cavity to into the cavity before it relaxes to its undeflected position. Some types of MEMS transducers have the capability of being driven both into and out of the cavity, and are also freely movable into and out of the cavity.

The compliant membrane 130 is deflected by the MEMS transducer member such as cantilevered beam 120, thereby providing a greater volumetric displacement than is provided by deflecting only a cantilevered beam of a conventional device that is not in contact with a compliant membrane 130. A greater volumetric displacement within a fluid ejector chamber is beneficial because it improves spatial compactness of the fluid ejector chamber for a given desired size of ejected drop. Desirable properties of compliant membrane 130 are that it have a Young's modulus that is much less than the Young's modulus of typical MEMS transducing materials, that it have a relatively large elongation before breakage, and that it have excellent chemical resistance (for compatibility with MEMS manufacturing processes and compatibility with the types of fluid to be ejected in the completed device). Polymers that are somewhat impermeable to the fluids to be ejected are also desirable. Some polymers, including some epoxies, are well adapted to be used as a compliant membrane 130. Examples include TMMR liquid resist or TMMF dry film, both being products of Tokyo Ohka Kogyo Co. The Young's modulus of cured TMMR or TMMF is about 2 GPa, as compared to approximately 70 GPa for a silicon oxide, around 100 GPa for a PZT piezoelectric, around 160 GPa for a platinum metal electrode, and around 300 GPa for silicon nitride. Thus the Young's modulus of the typical MEMS transducing member is at least a factor of 10 greater, and more typically more than a factor of 30 greater than that of the compliant membrane 130. A benefit of a low Young's modulus of the compliant membrane is that the design can allow for it to have negligible effect on the amount of deflection for the portion 131 where it covers the MEMS transducing member, but is readily deflected in the portion 133 of compliant membrane 130 that is nearby the MEMS transducing member but not directly contacted by the MEMS transducing member. In addition, the elongation before breaking of cured TMMR or TMMF is around 5%, so that it is capable of large deflection without damage.

Figure 3A:
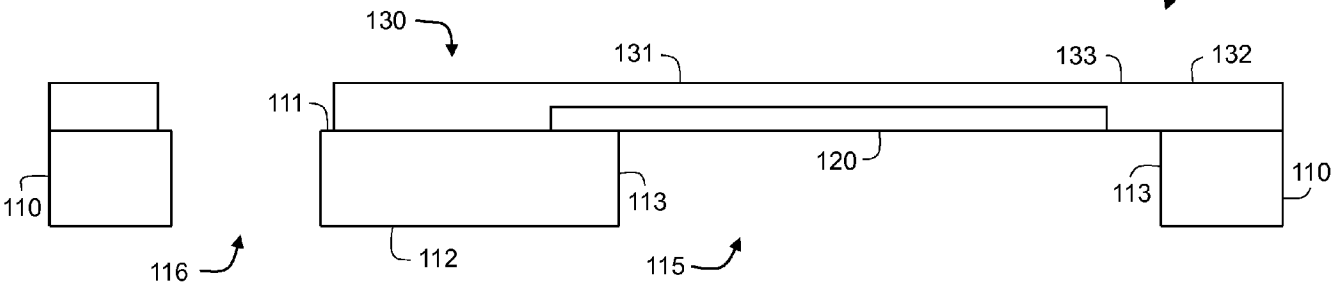
FIG. 3A is a cross-sectional view of an embodiment similar to that of FIG. 1A, but also including an additional through hole in the substrate.

FIG. 3A shows a cross sectional view of an embodiment of a composite MEMS transducer (similar to the view shown in FIG. 1B, but viewed from the opposite side) having a cantilevered beam 120 extending across a portion of cavity 115, where the cavity is a through hole from second surface 112 to first surface 111 of substrate 110. As in the embodiment of FIGS. 1A and 1B, compliant membrane 130 includes a first portion 131 that covers the MEMS transducing member, a second portion 132 that is anchored to first surface 111 of substrate 110, and a third portion 133 that overhangs cavity 115 while not contacting the MEMS transducing member. Additionally in the embodiment of FIG. 3A, the substrate further includes a second through hole 116 from second surface 112 to first surface 111 of substrate 110, where the second through hole 116 is located near cavity 115. In the example shown in FIG. 3A, no MEMS transducing member extends over the second through hole 116. In other embodiments where there is an array of composite MEMS transducers formed on substrate 110, the second through hole 116 can be the cavity of an adjacent MEMS composite transducer.

Figure 3B:
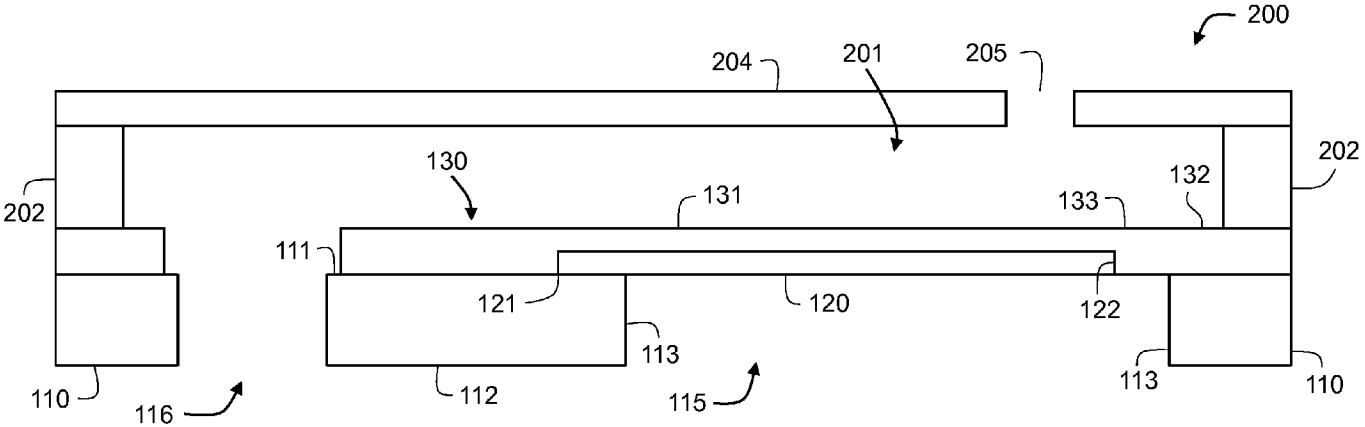
FIG. 3B is a cross-sectional view of a fluid ejector that incorporates the structure shown in FIG. 3A.

The configuration shown in FIG. 3A can be used in a fluid ejector 200 that ejects, for example, liquid in the form of drops as shown in FIG. 3B. In FIG. 3B, partitioning walls 202 are formed over the anchored portion 132 of compliant membrane 130. In other embodiments, partitioning walls 202 are formed on first surface 111 of substrate 110 in a region where compliant membrane 130 has been removed. Partitioning walls 202 define a chamber 201. A nozzle plate 204 is formed over the partitioning walls 202 and includes a nozzle 205 disposed near second end 122 of the cantilevered beam 120. Through hole 116 is a fluid feed that is fluidically connected to chamber 201, but not fluidically connected to cavity 115. Fluid is provided to cavity 201 through the fluidic feed (through hole 116). When an electrical signal is provided to the MEMS transducing member (cantilevered beam 120) at an electrical connection region (not shown), second end 122 of cantilevered beam 120 and a portion of compliant membrane 130 are deflected upward and away from cavity 115 (as in FIG. 2), so that a drop of fluid is ejected through nozzle 205.

Summarizing some of the significant characteristics of the fluid ejector 200 including the elements shown in FIGS. 1 to 3, fluid ejector 200 includes a substrate 110, first portions 113 of the substrate 110 defining an outer boundary 114 of a cavity 115, and second portions of the substrate 110 defining a fluidic feed 116. Fluid ejector 200 also includes a MEMS transducing member (such as cantilevered beam 120), a first portion of the MEMS transducing member (first end 121) being anchored to the substrate 110, a second portion of the MEMS transducing member (including second end 121) extending over at least a portion of the cavity 115, the second portion of the MEMS transducing member being free to move relative to the cavity 115 (particularly being able to deflect away from cavity 115, as shown in FIG. 2). Fluid ejector 200 also includes a compliant membrane 130 positioned in contact with the MEMS transducing member (cantilevered beam 120), a first portion 131 of the compliant membrane 130 covering the MEMS transducing member (120), and a second portion 132 of the compliant membrane 130 being anchored to the substrate 110. Partitioning walls 202 of fluid ejector 200 define a chamber 201 that is fluidically connected to the fluidic feed 116, At least the second portion of the MEMS transducing member (for example, the portion of cantilevered beam 120 that extends over at least a portion of cavity 115) is enclosed within chamber 201. Fluid ejector 200 also includes a nozzle 205 that is located near the second portion of the MEMS transducing member that extends over at least a portion of cavity 115. In some applications, it is advantageous for nozzle 205 to be located near where large displacement of the MEMS transducing member takes place along the z direction perpendicular to the plane of first surface 111 of substrate 110, such as near free second end 122 of cantilevered beam 120 (see FIG. 2). Nozzle 205 is located somewhat farther from fluidic feed 116.

In addition to the significant characteristics of fluid ejector 200 summarized above, the following attributes can also characterize fluid ejector 200 in the embodiment shown in FIGS. 1-3, as well as other embodiments. Typically for a fluid ejector 200, it is advantageous for the compliant membrane 130 to be anchored to substrate 110 around the outer boundary 114 of cavity 115, thereby providing not only structural support, but also a fluidic seal over cavity 115. Such a seal provides fluidic isolation between fluidic feed 116 and cavity 115, so that fluidic feed 116 is not fluidically connected to cavity 115. Compliant membrane 130 also helps to protect the MEMS transducing member, such as cantilevered beam 120. Compliant membrane 130 does not extend over fluidic feed 116, so that fluidic feed 116 is fluidically connected to chamber 201. Having a circular outer boundary 114 of cavity 115 (see FIG. 1A) and a substantially cylindrical shape of cavity 115 can both be beneficial for spatial compactness and improved packing density of arrays of fluid ejectors 200.

Figure 4:
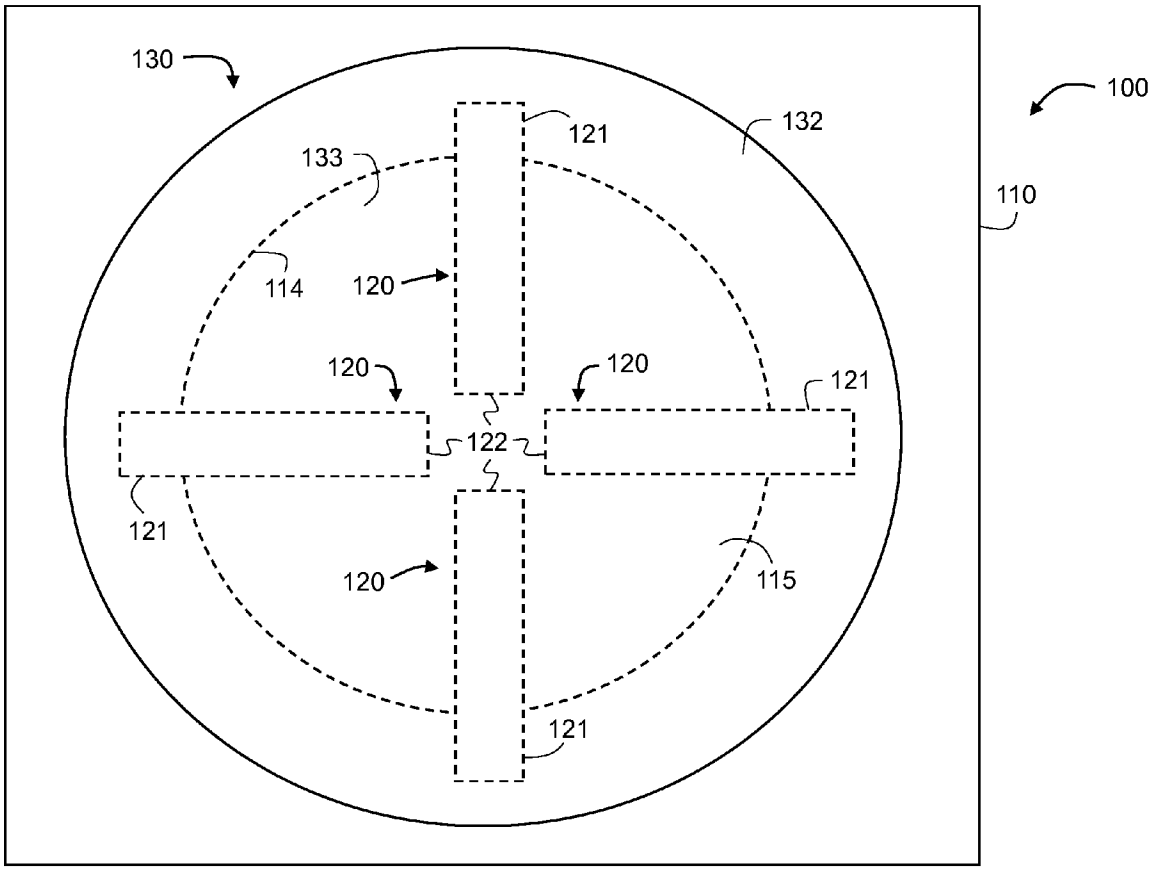
FIG. 4 is a top view of an embodiment similar to FIG. 1A, but with a plurality of cantilevered beams over the cavity.

There are many embodiments within the family of MEMS composite transducers 100 having one or more cantilevered beams 120 as the MEMS transducing member covered by the compliant membrane 130 that can be included in fluid ejector 200. The different embodiments within this family have different amounts of volumetric displacement and applied force, due for example to different amounts of coupling between multiple cantilevered beams 120 extending over a portion of cavity 115, and thereby are well suited to a variety of applications. FIG. 4 shows a top view of a MEMS composite transducer 100 having four cantilevered beams 120 as the MEMS transducing members, each cantilevered beam 120 including a first end that is anchored to substrate 110, and a second end 122 that is cantilevered over cavity 115. For simplicity, some details such as the portions 134 where the compliant membrane is removed are not shown in FIG. 4. In this example, the widths $w_1$ (see FIG. 1A) of the first ends 121 of the cantilevered beams 120 are all substantially equal to each other, and the widths $w_2$ (see FIG. 1A) of the second ends 122 of the cantilevered beams 120 are all substantially equal to each other. In addition, $w_1=w_2$ in the example of FIG. 3. Compliant membrane 130 includes first portions 131 that cover the cantilevered beams 120 (as seen more clearly in FIG. 1B), a second portion 132 that is anchored to substrate 110, and a third portion 133 that overhangs cavity 115 while not contacting the cantilevered beams 120. The compliant member 130 in this example provides some coupling between the different cantilevered beams 120. In addition, the effect of actuating all four cantilevered beams 120 results in an increased volumetric displacement, a larger combined force and a more symmetric displacement of the compliant membrane 130 than the single cantilevered beam 120 shown in FIGS. 1A, 1B and 2. The larger volumetric displacement and larger combined force can be particularly beneficial when the fluid to be ejected has a higher viscosity than a conventional aqueous ink.

Figure 5:
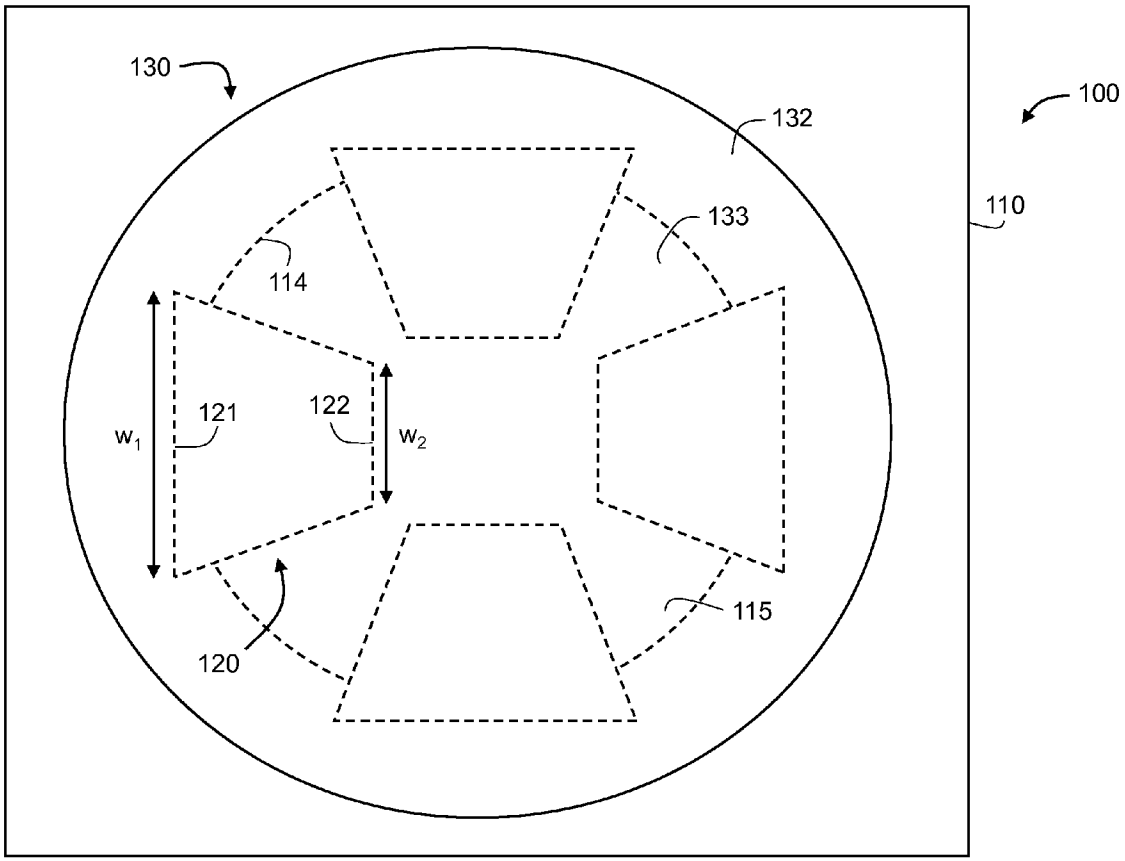
FIG. 5 is a top view of an embodiment similar to FIG. 4, but where the widths of the cantilevered beams are larger at their anchored ends than at their free ends.

FIG. 5 shows an embodiment similar to FIG. 4, but for each of the four cantilevered beams 120, the width $w_1$ at the anchored end 121 is greater than the width $w_2$ at the cantilevered end 122. The effect of actuating the cantilevered beams of FIG. 5 provides a greater volumetric displacement of compliant membrane 130, because a greater portion of the compliant membrane is directly contacted and supported by cantilevered beams 120. As a result the third portion 133 of compliant membrane 130 that overhangs cavity 115 while not contacting the cantilevered beams 120 is smaller in FIG. 5 than in FIG. 4. This reduces the amount of sag in third portion 133 of compliant membrane 130 between cantilevered beams 120 as the cantilevered beams 120 are deflected. The greater volumetric displacement of compliant membrane 130 provides improved spatial and energy efficiency when such MEMS composite transducer configurations are used in a fluid ejector 200. The larger combined force provided by actuating the plurality of cantilevered beams 120 enables the ejection of higher viscosity fluids as discussed above. Furthermore, because the force applied to eject a drop is due partially to the volumetric displacement of the compliant membrane 130, rather than only by transducing elements, less vibrational energy is coupled into substrate 110.

Figure 6A:
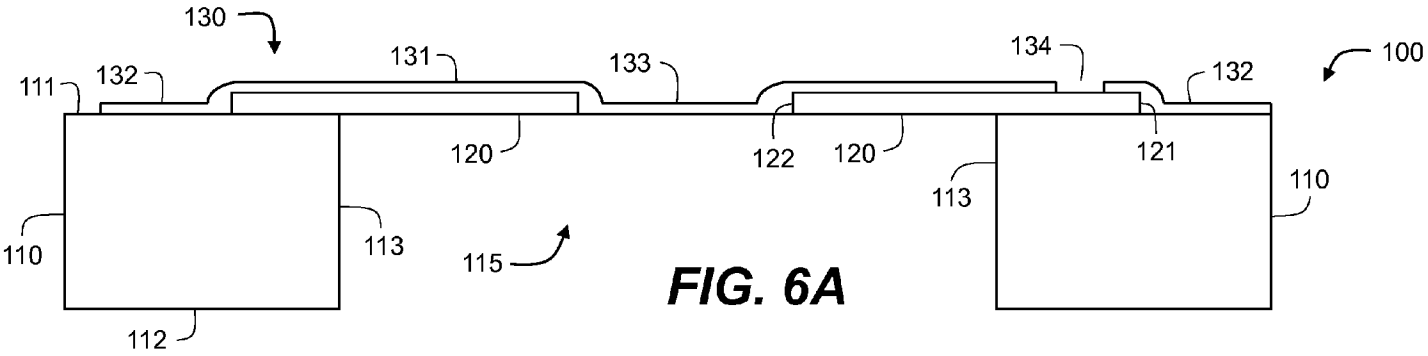
FIG. 6A is a cross-sectional view of an embodiment of a MEMS composite transducer including a plurality of cantilevered beams and a compliant membrane over a cavity.
Figure 6B:
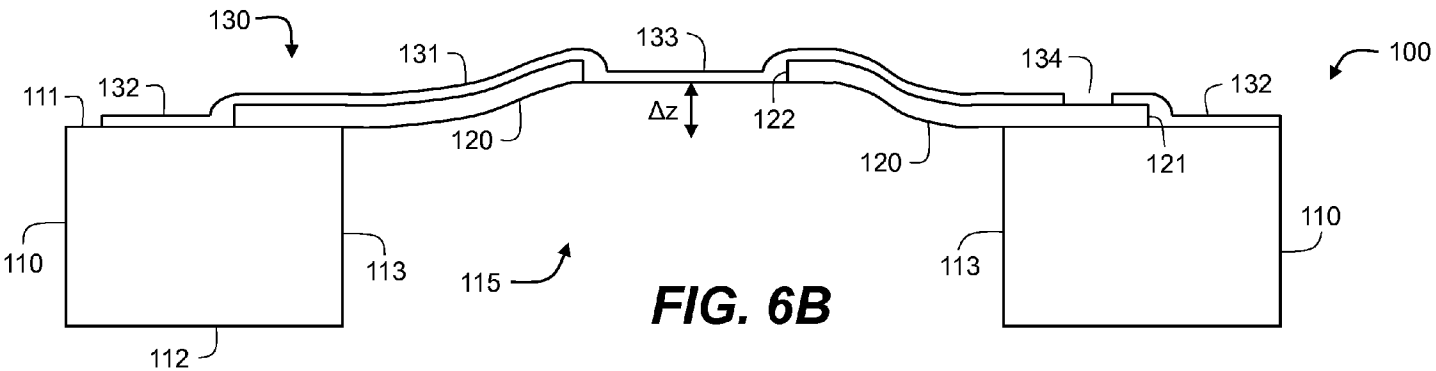
FIG. 6B is a cross-sectional view of the MEMS composite transducer of FIG. 6A in its deflected state.
Figure 7:
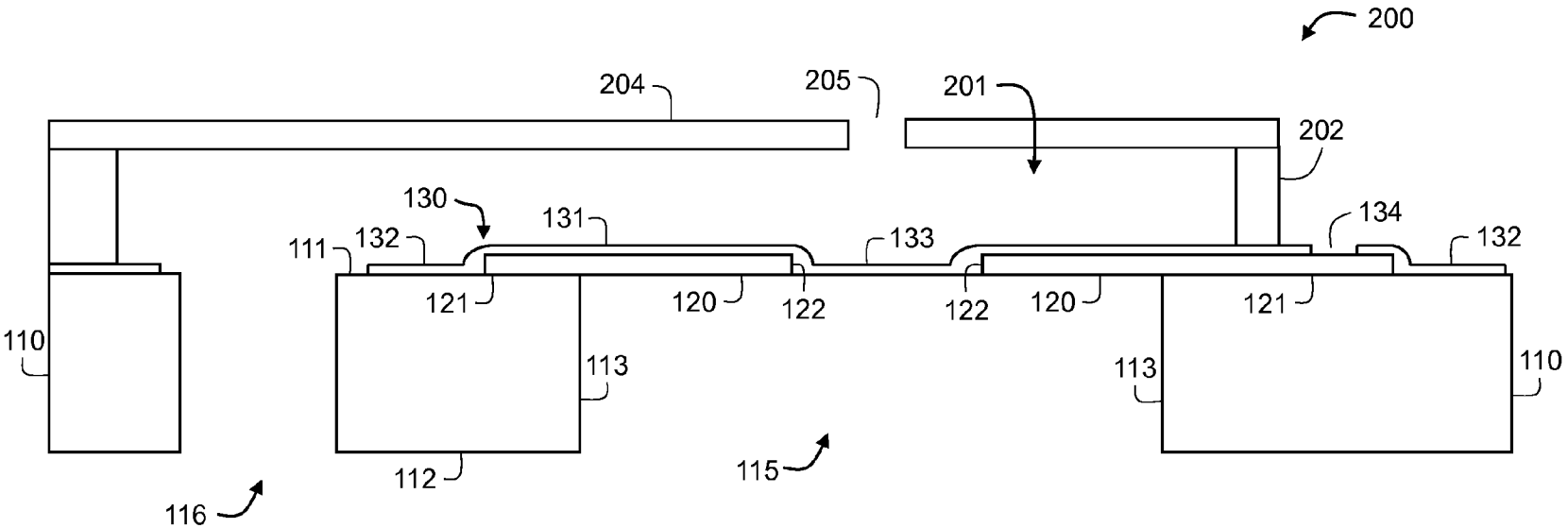
FIG. 7 is a cross-sectional view of a fluid ejector that incorporates the MEMS composite transducer of FIG. 6A.

FIGS. 6A and 6B show cross-sectional views (similar to the views shown in FIG. 1B and FIG. 2 respectively) for MEMS composite transducers having a plurality of cantilevered beams 120, for example, the cantilevered beam configurations shown in FIGS. 4 and 5. FIG. 7 shows a cross-sectional view of a fluid ejector 200 based on a MEMS composite transducer including a plurality of cantilevered beams 120, for example, the configurations shown in FIGS. 4 and 5, also including the fluidic feed 116, the partitioning walls 202, the chamber 201, the nozzle plate 204 and the nozzle 205. The electrical connection region is typically provided outside chamber 201 as indicated by portion 134 of compliant membrane 130 that is removed over the MEMS transducing member. In some embodiments, the individual cantilevered beams 120 are all electrically connected together, so that only a single portion 134 where compliant membrane 130 is removed over one of the cantilevered beams 120 is required.

Figure 8:
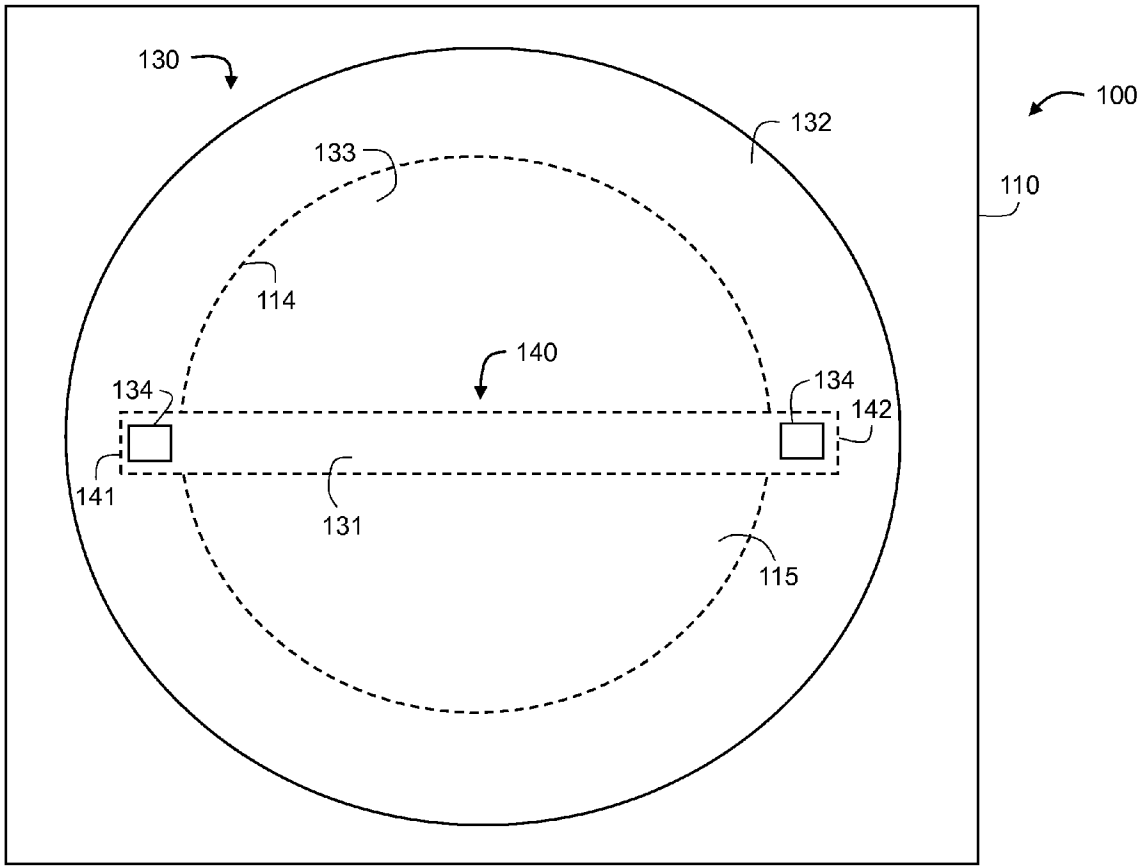
FIG. 8 is a top view of an embodiment where the MEMS composite transducer includes a doubly anchored beam and a compliant membrane.

FIG. 8 shows an embodiment of a MEMS composite transducer in a top view similar to FIG. 1A, but where the MEMS transducing member is a doubly anchored beam 140 extending across cavity 115 and having a first end 141 and a second end 142 that are each anchored to substrate 110. As in the embodiment of FIGS. 1A and 1B, compliant membrane 130 includes a first portion 131 that covers the MEMS transducing member, a second portion 132 that is anchored to first surface 111 of substrate 110, and a third portion 133 that overhangs cavity 115 while not contacting the MEMS transducing member. In the example of FIG. 8, a portion 134 of compliant membrane 130 is removed over both first end 141 and second end 142 in order to make electrical contact in order to pass a current from the first end 141 to the second end 142.

Figure 9A:
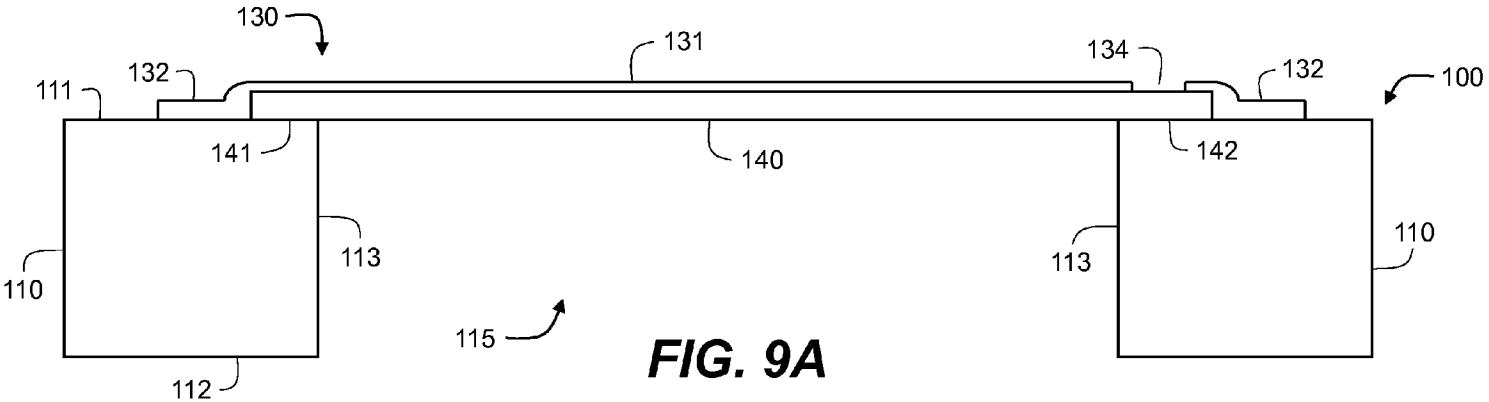
FIG. 9A is a cross-sectional view of the MEMS composite transducer of FIG. 8 in its undeflected state.

FIG. 9A shows a cross-sectional view of a doubly anchored beam 140 MEMS composite transducer in its undeflected state, similar to the cross-sectional view of the cantilevered beam 120 shown in FIG. 1B. In this example, a portion 134 of compliant membrane 130 is removed only at anchored second end 142 in order to make electrical contact on a top side of the MEMS transducing member to apply a voltage across the MEMS transducing member as is discussed in further detail below. Similar to FIGS. 1A and 1B, the cavity 115 is substantially cylindrical and extends from a first surface 111 of substrate 110 to a second surface 112 that is opposite first surface 111.

Figure 9B:
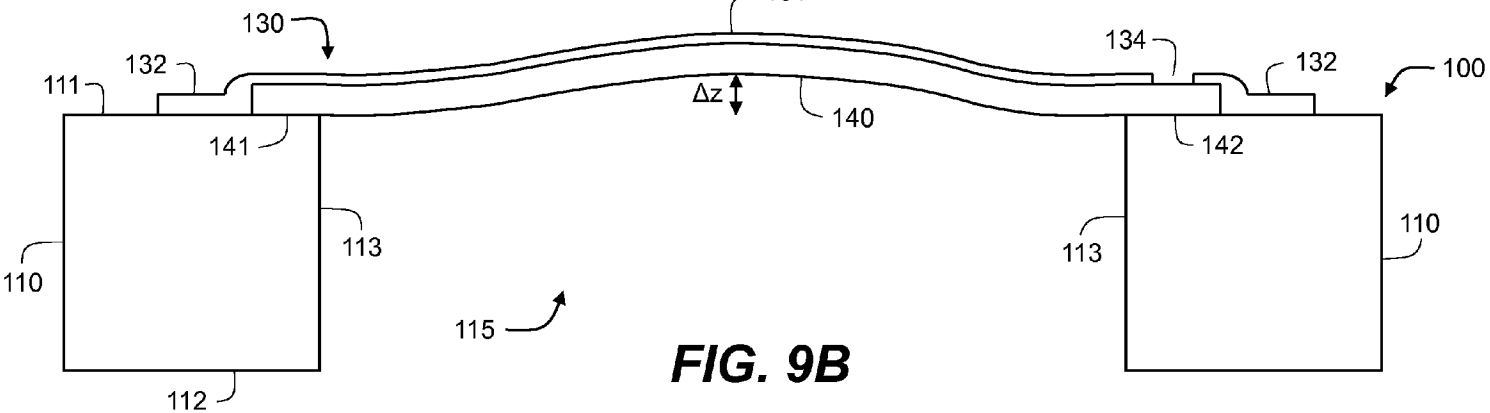
FIG. 9B is a cross-sectional view of the MEMS composite transducer of FIG. 8 in its deflected state.

FIG. 9B shows a cross-sectional view of the doubly anchored beam 140 in its deflected state, similar to the cross-sectional view of the cantilevered beam 120 shown in FIG. 2. The portion of doubly anchored beam 140 extending across cavity 115 is deflected up and away from the undeflected position of FIG. 9A, so that it raises up the portion 131 of compliant membrane 130. The maximum deflection at or near the middle of doubly anchored beam 140 is shown as $\delta=\Delta z$.

Figure 10:
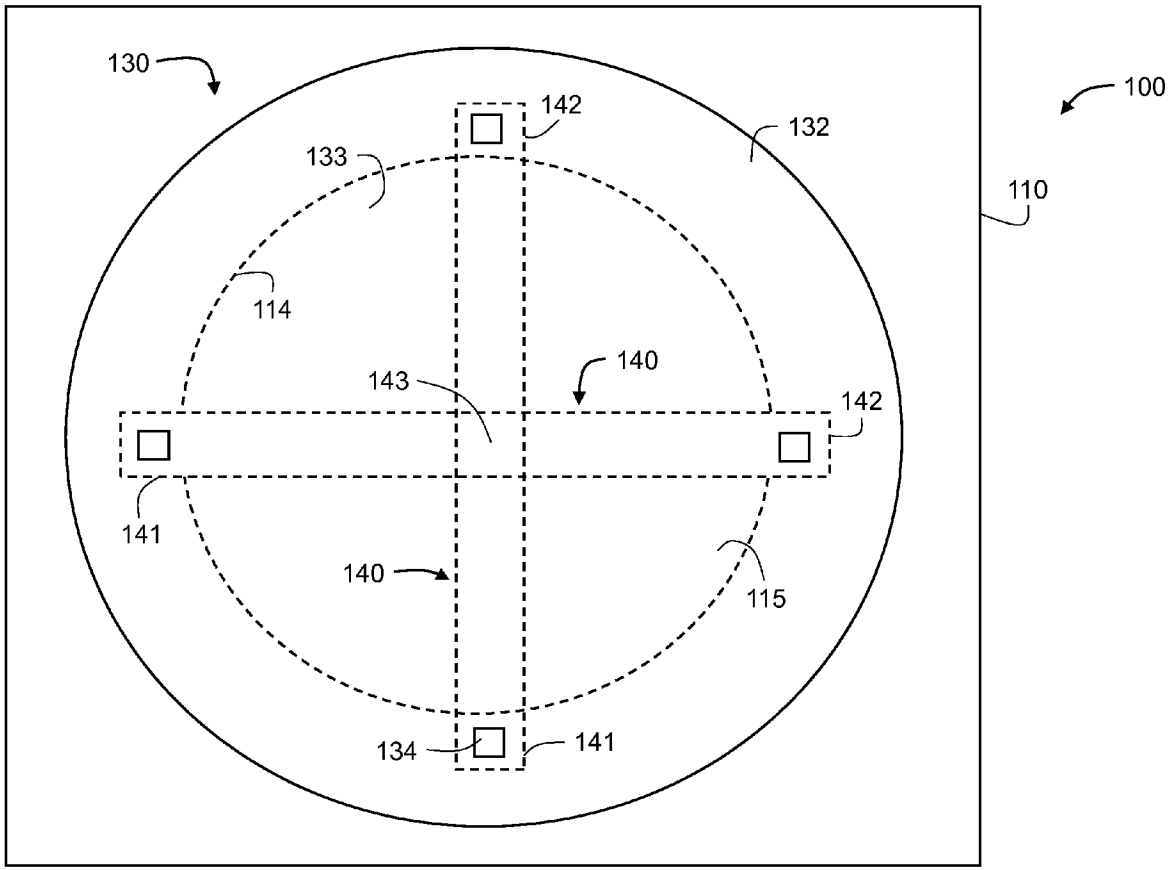
FIG. 10 is a top view of an embodiment where the MEMS composite transducer includes two intersecting doubly anchored beams and a compliant membrane.

FIG. 10 shows a top view of an embodiment similar to that of FIG. 8, but with a plurality (for example, two) of doubly anchored beams 140 anchored to the substrate 110 at their first end 141 and second end 142. In this embodiment both doubly anchored beams 140 are disposed substantially radially across circular cavity 115, and therefore the two doubly anchored beams 140 intersect each other over the cavity at an intersection region 143. Other embodiments are contemplated in which a plurality of doubly anchored beams do not intersect each other or the cavity is not circular. For example, two doubly anchored beams can be parallel to each other and extend across a rectangular cavity.

Figure 11:
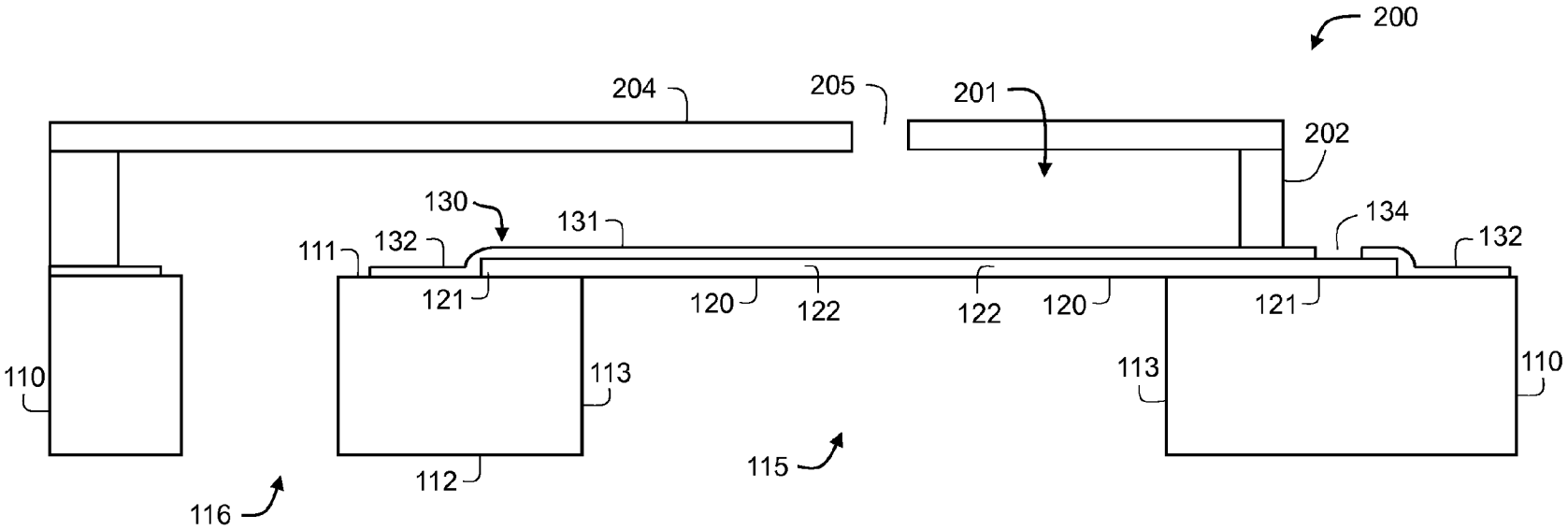
FIG. 11 is a cross-sectional view of a fluid ejector that incorporates the MEMS composite transducer of FIG. 9A.

FIG. 11 shows a cross-sectional view of a fluid ejector 200, similar to that shown in FIG. 7, but based on a MEMS composite transducer including at least one doubly anchored beam 140 and a compliant membrane 130, for example, the MEMS composite transducer configurations shown in FIGS. 8 and 10, also including the fluidic feed 116, the partitioning walls 202, the chamber 201, the nozzle plate 204 and the nozzle 205.

Figure 12:
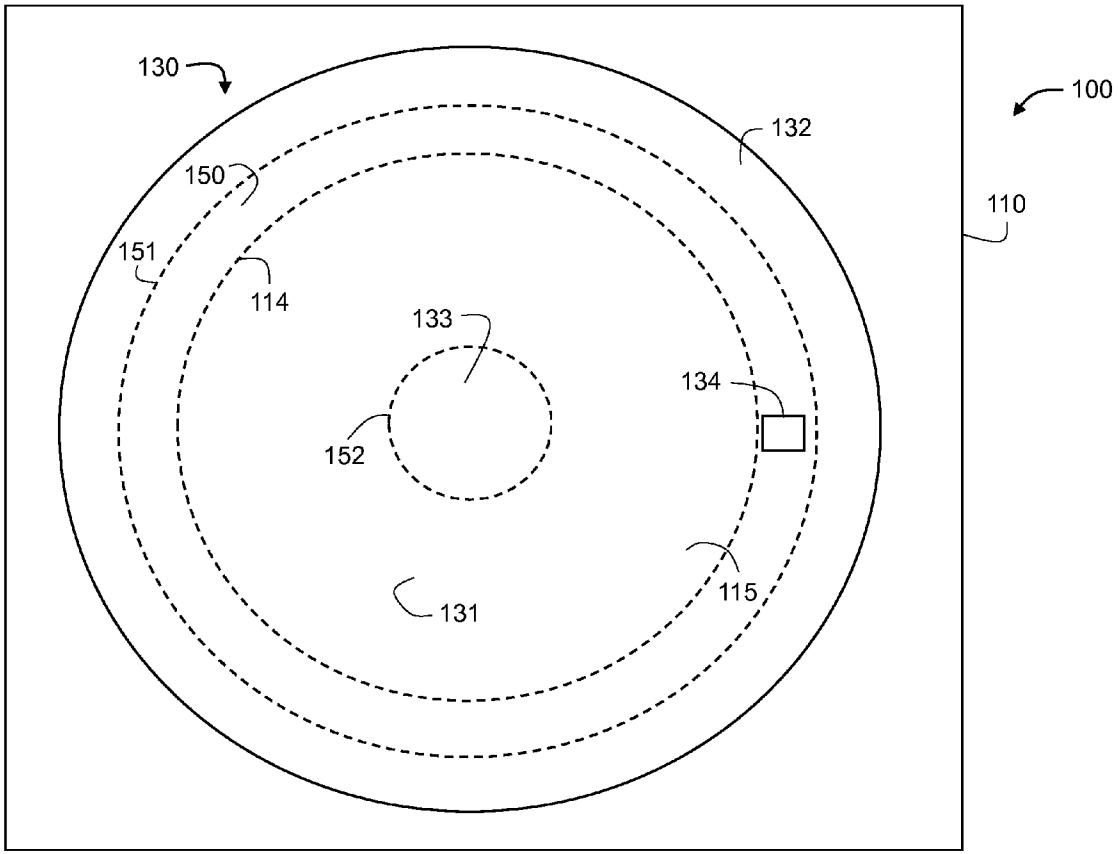
FIG. 12 is a top view of an embodiment where the MEMS composite transducer includes a clamped sheet and a compliant membrane.

FIG. 12 shows an embodiment of a MEMS composite transducer in a top view similar to FIG. 1A, but where the MEMS transducing member is a clamped sheet 150 extending across a portion of cavity 115 and anchored to the substrate 110 around the outer boundary 114 of cavity 115. Clamped sheet 150 has a circular outer boundary 151 and a circular inner boundary 152, so that it has an annular shape. As in the embodiment of FIGS. 1A and 1B, compliant membrane 130 includes a first portion 131 that covers the MEMS transducing member, a second portion 132 that is anchored to first surface 111 of substrate 110, and a third portion 133 that overhangs cavity 115 while not contacting the MEMS transducing member. In a fourth region 134, compliant membrane 130 is removed such that it does not cover a portion of the MEMS transducing member, so that electrical contact can be made as is discussed in further detail below. Cross-sectional views of the deflected and undeflected states of a MEMS composite transducer including a clamped sheet 150 of the type shown in FIG. 12 are similar to the cross-sectional views shown in FIGS. 6A and 6B with reference numbers 120, 121 and 122 being replaced by reference numbers 150, 151 and 152 respectively. Similarly a cross-sectional view of a fluid ejector 200 including a MEMS composite transducer having a clamped sheet of the type shown in FIG. 12 is similar to the one shown in FIG. 7, again, reference numbers 120, 121 and 122 being replaced by reference numbers 150, 151 and 152 respectively.

Figure 13:
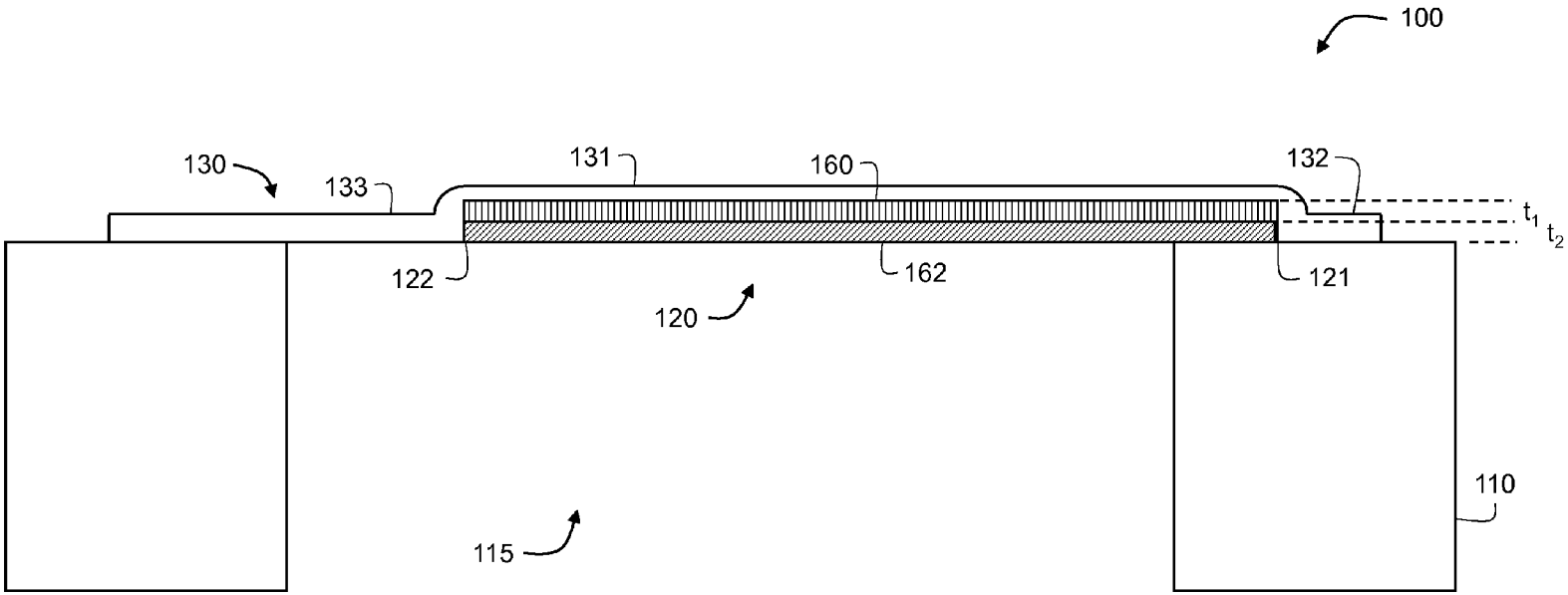
FIG. 13 is a cross-sectional view showing additional structural detail of an embodiment of a MEMS composite transducer including a cantilevered beam.

A variety of transducing mechanisms and materials can be used in the fluid ejector 200 with a MEMS composite transducer of the present invention. MEMS transducing mechanisms described herein for fluid ejectors include a deflection out of the plane of the undeflected MEMS composite transducer, some including a bending motion, as shown in FIGS. 2, 6B and 9B. A transducing mechanism including bending is typically provided by a MEMS transducing material 160 in contact with a reference material 162, as shown for the cantilevered beam 120 in FIG. 13. In the example of FIG. 13, the MEMS transducing material 160 is shown on top of reference material 162, but alternatively the reference material 162 can be on top of the MEMS transducing material 160, depending upon whether it is desired to cause bending of the MEMS transducing member (for example, cantilevered beam 120) into the cavity 115 or away from the cavity 115, and whether the MEMS transducing material 160 is caused to expand more than or less than an expansion of the reference material 162.

One example of a MEMS transducing material 160 is the high thermal expansion member of a thermally bending bimorph. Titanium aluminide can be the high thermal expansion member for example, as disclosed in commonly assigned U.S. Pat. No. 6,561,627. The reference material 162 can include an insulator such as silicon oxide, or silicon oxide plus silicon nitride. When a current pulse is passed through the titanium aluminide MEMS transducing material 160, it causes the titanium aluminide to heat up and expand. The reference material 160 is not self-heating and its thermal expansion coefficient is less than that of titanium aluminide, so that the titanium aluminide MEMS transducing material 160 expands at a faster rate than the reference material 162. As a result, a cantilever beam 120 configured as in FIG. 13 would tend to bend downward into cavity 115 as the MEMS transducing material 160 is heated. Dual-action thermally bending actuators can include two MEMS transducing layers (deflector layers) of titanium aluminide and a reference material layer sandwiched between, as described in commonly assigned U.S. Pat. No. 6,464,347. Deflections into the cavity 115 or out of the cavity can be selectively actuated by passing a current pulse through either the upper deflector layer or the lower deflector layer respectively.

A second example of a MEMS transducing material 160 is a shape memory alloy such as a nickel titanium alloy. Similar to the example of the thermally bending bimorph, the reference material 162 can be an insulator such as silicon oxide, or silicon oxide plus silicon nitride. When a current pulse is passed through the nickel titanium MEMS transducing material 160, it causes the nickel titanium to heat up. A property of a shape memory alloy is that a large deformation occurs when the shape memory alloy passes through a phase transition. If the deformation is an expansion, such a deformation would cause a large and abrupt expansion while the reference material 162 does not expand appreciably. As a result, a cantilever beam 120 configured as in FIG. 13 would tend to bend downward into cavity 115 as the shape memory alloy MEMS transducing material 160 passes through its phase transition. The deflection would be more abrupt than for the thermally bending bimorph described above.

A third example of a MEMS transducing material 160 is a piezoelectric material. Piezoelectric materials can be particularly advantageous. A voltage applied across the piezoelectric MEMS transducing material 160, typically applied to conductive electrodes (not shown) on the two sides of the piezoelectric MEMS transducing material, can cause an expansion or a contraction, depending upon whether the voltage is positive or negative and whether the sign of the piezoelectric coefficient is positive or negative. Typically in a piezoelectric fluid ejection device, a single polarity of electrical signal would be applied however, so that the piezoelectric material does not tend to become depoled. While the voltage applied across the piezoelectric MEMS transducing material 160 causes an expansion or contraction, the reference material 162 does' not expand or contract, thereby causing a deflection into the cavity 115 or away from the cavity 115 respectively. The piezoelectric MEMS transducing material 160 and the reference material 162 do not tend to heat up appreciably, and thereby do not impart excessive heat to the fluid to be ejected. Reference material 162 can also be sandwiched between two piezoelectric material layers to provide separate control of deflection into cavity 115 or away from cavity 115 without depoling the piezoelectric material. There are a variety of types of piezoelectric materials. A family of interest includes piezoelectric ceramics, such as lead zirconate titanate or PZT.

As the MEMS transducing material 160 expands or contracts, there is a component of motion within the plane of the MEMS composite transducer, and there is a component of motion out of the plane (such as bending). Bending motion (as in FIGS. 2, 6B and 9B) will be dominant if the Young's modulus and thickness of the MEMS transducing material 160 and the reference material 162 are comparable. In other words, if the MEMS transducing material 160 has a thickness $t_1$ and if the reference material has a thickness $t_2$, then bending motion will tend to dominate if $t_2>0.5t_1$ and $t_2<2t_1$, assuming comparable Young's moduli. By contrast, if $t_2<0.2t_1$, motion within the plane of the MEMS composite transducer will tend to dominate.

Figure 14:
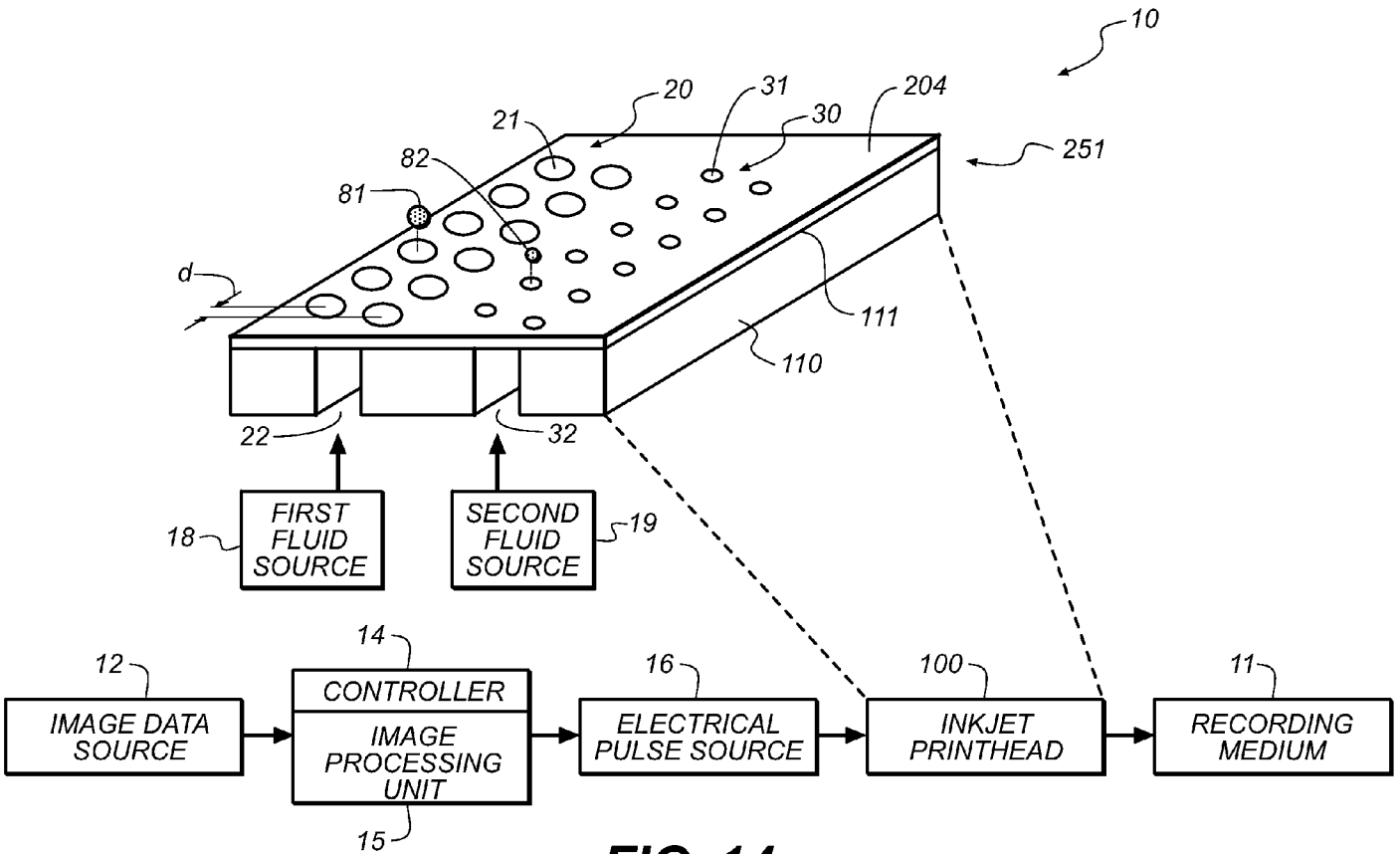
FIG. 14 is a schematic representation of an inkjet printer system.

One important use for fluid ejectors is in an inkjet printing system. Referring to FIG. 14, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead, which includes at least one inkjet printhead die 251.

In the example shown in FIG. 14, there are two nozzle arrays formed in a nozzle plate 204 over a first surface 111 of substrate 110 of inkjet printhead die 251, the nozzle arrays corresponding respectively to two fluid ejector arrays. Nozzles 21 in the first nozzle array 20 have a larger opening area than nozzles 31 in the second nozzle array 30. In this example, each of the two nozzle arrays has two staggered rows of nozzles. The effective nozzle spacing then in each array is d, which is half the spacing in each staggered row. If pixels on the recording medium 11 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway including a fluidic feed (for example, fluidic feed 116 shown in FIGS. 3A, 3B, 7 and 11). Ink delivery pathway 22 is in fluid communication with the first nozzle array 20, and ink delivery pathway 32 is in fluid communication with the second nozzle array 30. Portions of ink delivery pathways 22 and 32 are shown in FIG. 14 as openings through printhead die substrate 110. One or more inkjet printhead die 251 can be included in an inkjet printhead, but for greater clarity only one inkjet printhead die 241 is shown in FIG. 14. The printhead die are arranged on a support member as discussed below relative to FIG. 15. In FIG. 14, first fluid source 18 supplies ink to first nozzle array 20 via ink delivery pathway 22, and second fluid source 19 supplies ink to second nozzle array 30 via ink delivery pathway 32. Although distinct fluid sources 18 and 19 are shown, in some applications it may be beneficial to have a single fluid source supplying ink to both the first nozzle array 20 and the second nozzle array 30 via ink delivery pathways 22 and 32 respectively. Also, in some embodiments, fewer than two or more than two nozzle arrays can be included on printhead die 251. In some embodiments, all nozzles on inkjet printhead die 251 can be the same size, rather than having multiple sized nozzles on inkjet printhead die 251.

In a drop-on-demand printhead, a fluid ejector includes a drop forming element as well as the nozzle. In embodiments of the present invention, the drop forming elements associated with the nozzles include the various types of MEMS composite transducers described above. Electrical pulses from electrical pulse source 16 are sent to the various fluid ejectors in the array according to the desired deposition pattern. In the example of FIG. 14, liquid drops 81 ejected from the first nozzle array 20 are larger than liquid drops 82 ejected from the second nozzle array 30, due to the larger nozzle opening area. Typically other aspects of the liquid drop forming elements associated respectively with nozzle arrays 20 and 30 are also sized differently in order to optimize the liquid drop ejection process for the different sized liquid drops. In particular, the MEMS composite transducers for different sized liquid drops can have different sized cavities; different sized, shaped and number of cantilevered beams; or different sized chambers. During operation, drops of ink, or another type of liquid, are deposited on a recording medium 11.

Figure 15:
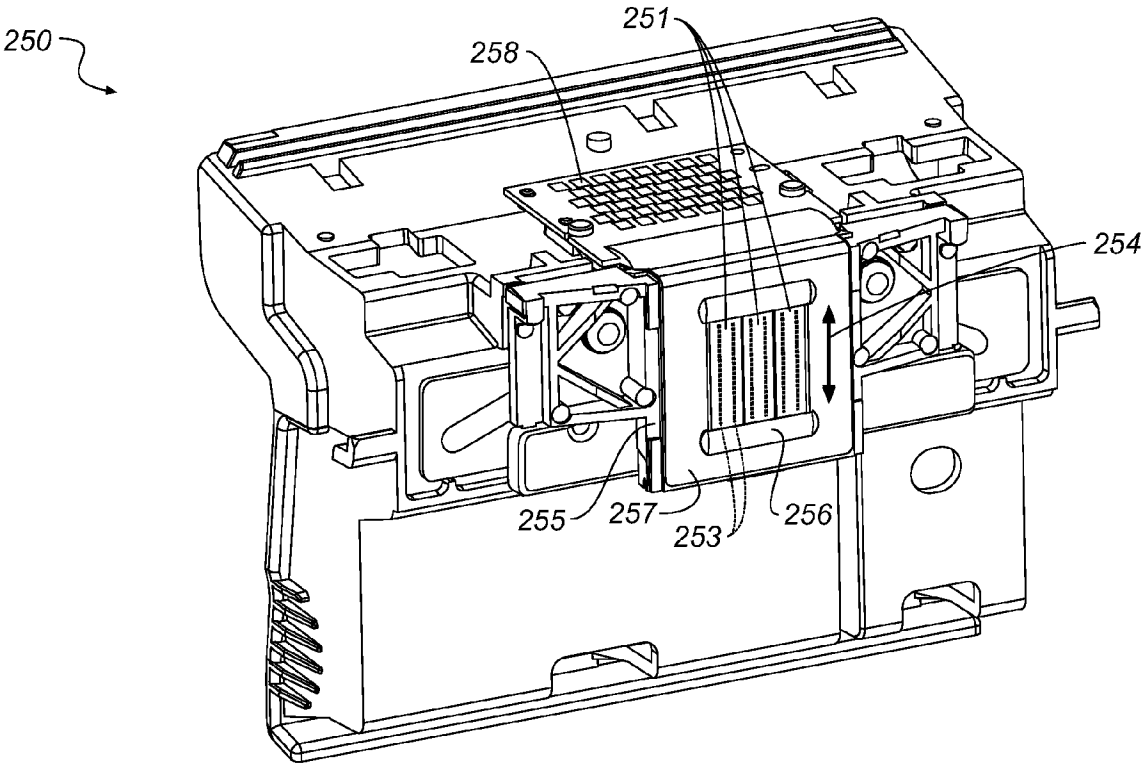
FIG. 15 is a perspective view of a portion of a printhead.

FIG. 15 shows a perspective view of a portion of a printhead 250. Printhead 250 includes three printhead die 251 mounted on a mounting member 255, each printhead die 251 containing two nozzle arrays 253, so that printhead 250 contains six nozzle arrays 253 altogether. The six nozzle arrays 253 in this example can each be connected to separate ink sources (not shown in FIG. 15); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 11. Following the printing of a swath, the recording medium 11 is advanced along a media advance direction that is substantially parallel to nozzle array direction 254.

Also shown in FIG. 15 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 210 (see FIG. 16), connector board 258 is electrically connected to a connector (not shown) on the carriage 200, so that electrical signals can be transmitted to the printhead die 251.

Figure 16:
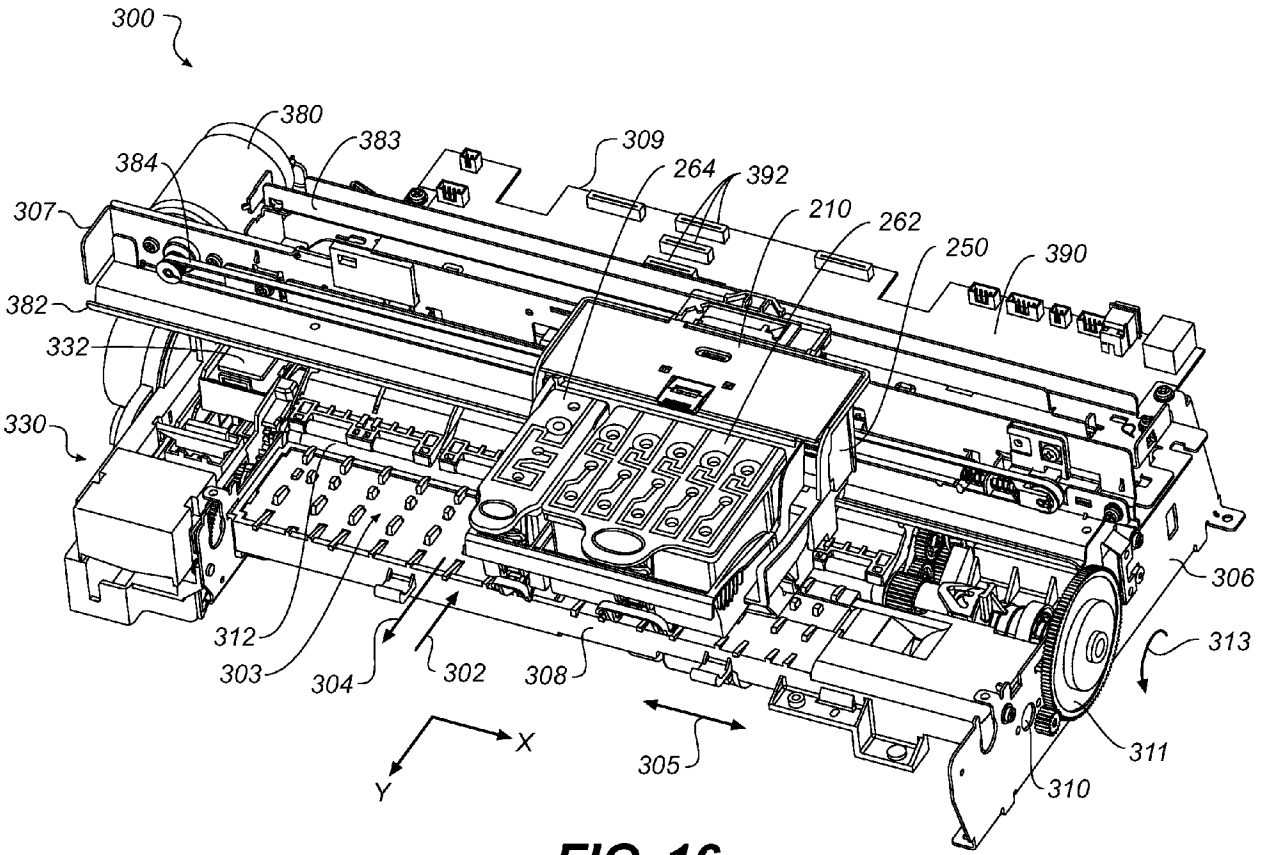
FIG. 16 is a perspective view of a portion of a carriage printer.

FIG. 16 shows a portion of a desktop carriage printer. Some of the parts of the printer have been hidden in the view shown in FIG. 16 so that other parts can be more clearly seen. Printer chassis 300 has a print region 303 across which carriage 210 is moved back and forth in carriage scan direction 305 along the X axis, between the right side 306 and the left side 307 of printer chassis 300, while drops are ejected from printhead die 251 (not shown in FIG. 16) on printhead 250 that is mounted on carriage 210. Carriage motor 380 moves belt 384 to move carriage 210 along carriage guide rail 382. An encoder sensor (not shown) is mounted on carriage 210 and indicates carriage location relative to an encoder fence 383.

Printhead 250 is mounted in carriage 210, and multi-chamber ink supply 262 and single-chamber ink supply 264 are mounted in the printhead 250. The mounting orientation of printhead 250 is rotated relative to the view in FIG. 15, so that the printhead die 251 are located at the bottom side of printhead 250, the drops of ink being ejected downward onto the recording medium in print region 303 in the view of FIG. 16. Multi-chamber ink supply 262, in this example, contains five ink sources: cyan, magenta, yellow, photo black, and colorless protective fluid; while single-chamber ink supply 264 contains the ink source for text black. Paper or other recording medium (sometimes generically referred to as paper or media herein) is loaded along paper load entry direction 302 at the input region toward the front of printer chassis 308.

Figure 17:
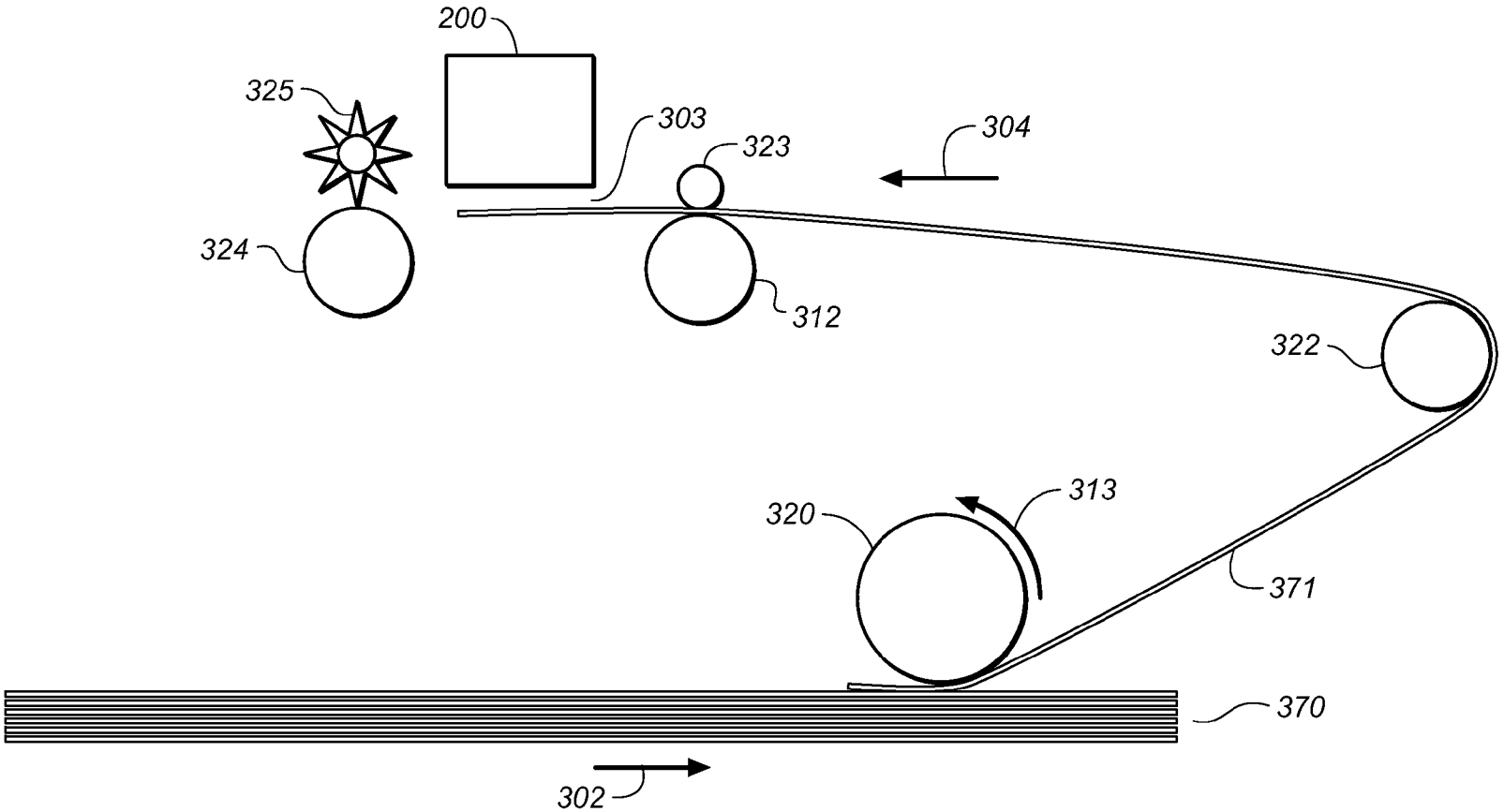
FIG. 17 is a schematic side view of an exemplary paper path in a carriage printer.

A variety of rollers are used to advance the medium through the printer as shown schematically in the side view of FIG. 17. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 16). The paper is then moved by feed roller 312 and idler roller(s) 323 to advance along the Y axis across print region 303, and from there to a discharge roller 324 and star wheel(s) 325 so that printed paper exits along media advance direction 304 to an output region. Feed roller 312 includes a feed roller shaft along its axis, and feed roller gear 311 is mounted on the feed roller shaft. A rotary encoder (not shown) can be coaxially mounted on the feed roller shaft in order to monitor the angular rotation of the feed roller.

The motor that powers the paper advance rollers is not shown in FIG. 16, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 16, is the maintenance station 330 including a cap 332.

Toward the rear of the printer chassis 309, in this example, is located the electronics board 390, which includes cable connectors 392 for communicating via cables (not shown) to the printhead carriage 210 and from there to the printhead 250. Also on the electronics board are typically mounted motor controllers for the carriage motor 380 and for the paper advance motor, a processor and/or other control electronics (shown schematically as controller 14 and image processing unit 15 in FIG. 14) for controlling the printing process, and an optional connector for a cable to a host computer.

Figure 18:
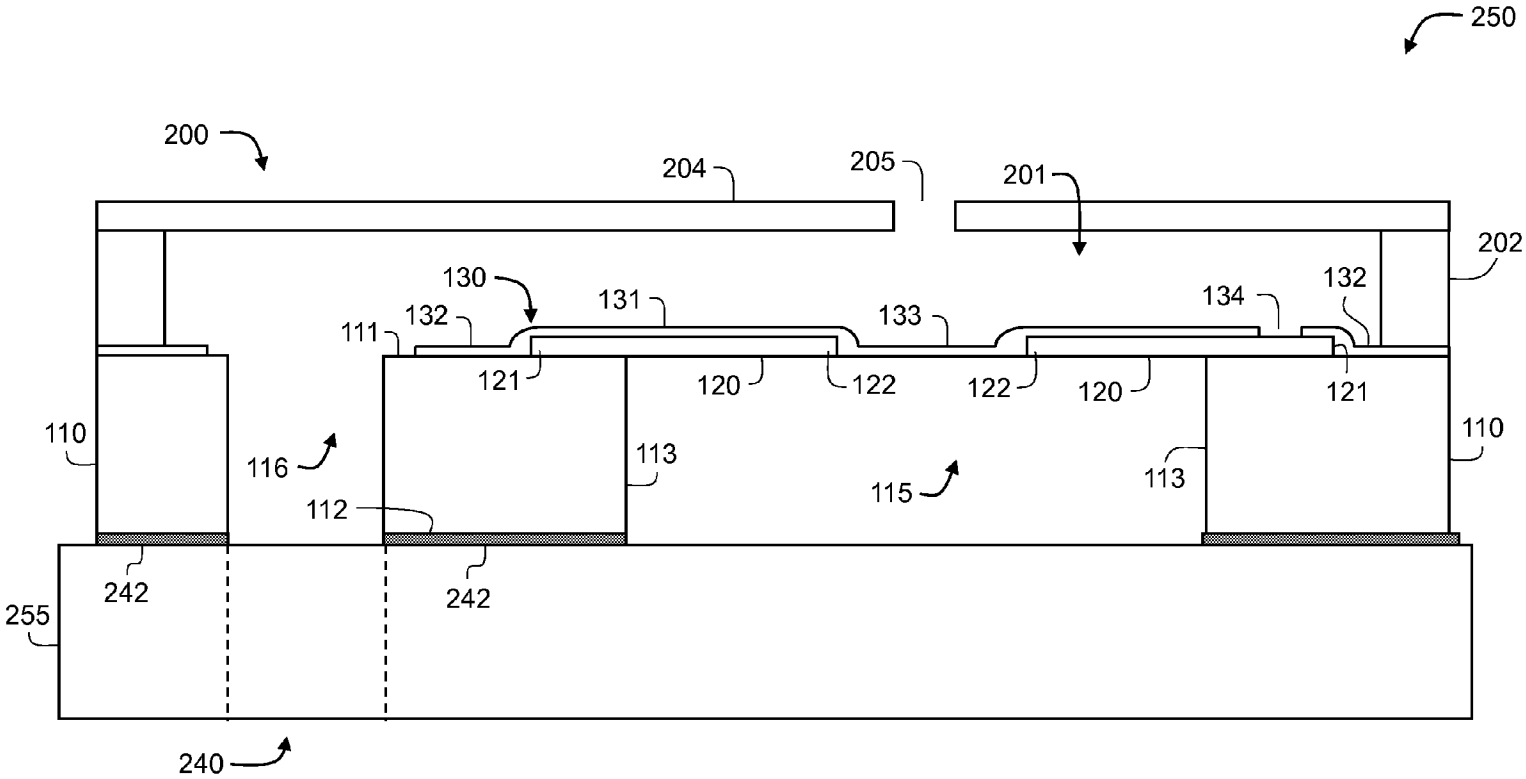
FIG. 18 is a cross-sectional view of a portion of a printhead including a fluid ejector of the type shown in FIG. 7.

FIG. 18 shows a cross-sectional view of a portion of printhead 250 including a fluid ejector 200 of the type shown in FIG. 7 mounted on mounting member 255. Mounting member includes an ink passageway 240 that is fluidically connected to fluidic feed 116, but not fluidically connected to cavity 115. A sealing member 240 is configured to seal around fluidic feed 116 and ink passageway 240. In some embodiments, sealing member 240 is an adhesive that also bonds surface 112 of substrate 110 of fluid ejector 200 to mounting member 255. A fluid supply (for example, fluid supply 18 or 19 of FIG. 14 or one of the ink supplies in multi-chamber ink supply 262 or single chamber ink supply 264 in FIG. 16) is fluidically connected to the ink passageway 240 of mounting member 255.

For printhead embodiments such as the one shown in FIG. 14, where there are two ink delivery pathways 22 and 32 corresponding to two fluidic feeds 116, mounting member 255 includes a second ink passageway 240, and sealing member 242 is also configured to seal around the second fluid feed 116 and the second ink passageway 240.

In addition to inkjet printing applications in which the fluid typically includes a colorant for printing an image, fluid ejector 200 incorporating a MEMS composite transducer as described above can also be advantageously used in ejecting other types of fluidic materials. Such materials include functional materials for fabricating devices (including conductors, resistors, insulators, magnetic materials, and the like), structural materials for forming three-dimensional structures, biological materials, and various chemicals. Fluid ejector 200 can provide sufficient force to eject fluids, for example, liquids, having a higher viscosity than typical inkjet inks, and does not impart excessive heat into the fluids that could damage them or change their properties undesirably.

Figure 19:
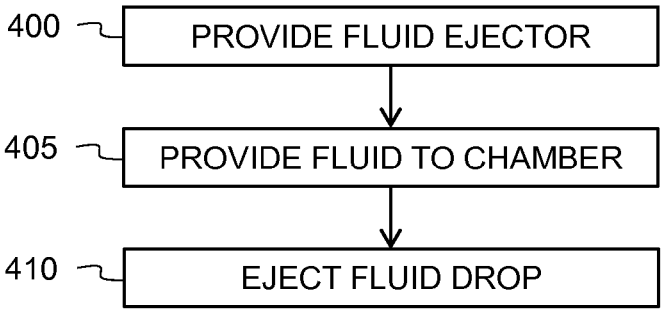
FIG. 19 shows a block diagram describing an example embodiment of a method of ejecting a drop of fluid using the fluid ejector described herein.

Having described a variety of exemplary structural embodiments of fluid ejectors including MEMS composite transducers, a context has been provided for next describing methods of operation with reference to FIG. 19. Having provided a fluid ejector 200 including a MEMS composite transducer as described above in step 400, a quantity of fluid is supplied to chamber 201 through fluidic feed 116 IN step 405. An electrical pulse is than applied to the MEMS transducing member (such as one or more cantilevered beams 120) to eject a drop of fluid through nozzle 205 IN step 410. In particular, application of the electrical pulse to the MEMS transducing member causes the portion of the MEMS transducing member that extends over at least a portion of cavity 115 to deflect toward nozzle 205, thereby ejecting a drop. Because the deflection of the MEMS transducing member also causes deflection of the portions 131 and 133 of the compliant membrane toward the nozzle (see FIGS. 6B and 7), an increased volumetric deflection is provided relative to conventional MEMS transducers that do not include the compliant membrane 130.

After a first drop of fluid has been ejected from fluid ejector 200, it is typically desired to eject subsequent drops. In order to do that, an additional quantity of fluid is supplied to chamber 201 through fluidic feed 116. A second electrical pulse is applied to the MEMS transducing member to eject a second drop of fluid through nozzle 205. The electrical pulse or waveform can include a constant amplitude or a varying amplitude, as well as a pulse duration. The waveform can further include a plurality of pulses separated by off times. All of these variations are contemplated herein as being included in pulse shape. Particularly if the state of fill of the chamber 201 or the shape of the meniscus of the fluid relative to nozzle 205 is different at the time of ejecting the second drop as compared to the first drop, it can be advantageous to use a first pulse shape to eject the first drop and a second pulse shape (different from the first pulse shape) for the second drop. A controller (such as controller 14 described above relative to a printing application) can be used to control a timing and a shape of the electrical pulse(s). Input data (for example from image source 12 described above relative to a printing application) can be provided to the controller for controlling the timing and shape of the electrical pulse(s). Controllers and input data can be used for non-printing applications as well.

Whether for a printing application or a non-printing application, it can be advantageous to provide a plurality of fluid ejectors 200, each including a MEMS composite transducer as described above. Ejecting drops from each fluid ejector 200 is done as described above, where electrical pulses are selectively and controllably provided to the plurality of MEMS transducing members. To fire a plurality of different fluid ejectors 200 at substantially the same time, electrical pulses would be provided to each of the corresponding plurality of MEMS transducing members with substantially the same timing For drop ejectors of a similar size and for ejecting a drop of a similar size, the electrical pulses can have substantially the same shape. For drop ejectors of different sizes, or for ejecting drops of different size, or for ejecting drops from chambers with different states of fill or meniscus shape, the electrical pulses can be controlled to have different shapes.

The invention has been described in detail with particular reference to certain preferred embodiments thereof, but it will be understood that variations and modifications can be effected within the scope of the invention.

PARTS LIST

10 Inkjet printer system
11 Recording medium
12 Image data source
13 Heater
14 Controller
15 Image processing unit
16 Electrical pulse source
18 First fluid source
19 Second fluid source
20 First nozzle array
21 Nozzle(s)
22 Ink delivery pathway (for first nozzle array)
30 Second nozzle array
31 Nozzle(s)
32 Ink delivery pathway (for second nozzle array)
81 Drop(s) (ejected from first nozzle array)
82 Drop(s) (ejected from second nozzle array)
100 MEMS composite transducer
110 Substrate
111 First surface of substrate
112 Second surface of substrate
113 Portions of substrate (defining outer boundary of cavity)
114 Outer boundary
115 Cavity
116 Through hole (fluidic feed)
118 Mass
120 Cantilevered beam
121 Anchored end (of cantilevered beam)
122 Cantilevered end (of cantilevered beam)
130 Compliant membrane
131 Covering portion of compliant membrane
132 Anchoring portion of compliant membrane
133 Portion of compliant membrane overhanging cavity
134 Portion where compliant membrane is removed
135 Hole (in compliant membrane)
138 Compliant passivation material
140 Doubly anchored beam
141 First anchored end
142 Second anchored end
143 Intersection region
150 Clamped sheet
151 Outer boundary (of clamped sheet)
152 Inner boundary (of clamped sheet)
160 MEMS transducing material
162 Reference material
200 Fluid ejector
201 Chamber

202 Partitioning walls
204 Nozzle plate
205 Nozzle
210 Carriage
240 Ink passageway (of mounting member)
242 Sealing member
250 Printhead
251 Printhead die
253 Nozzle array
254 Nozzle array direction
255 Mounting member
256 Encapsulant
257 Flex circuit
258 Connector board
262 Multi-chamber ink supply
264 Single-chamber ink supply
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
332 Cap
370 Stack of media
371 Top piece of medium
380 Carriage motor
382 Carriage guide rail
383 Encoder fence
384 Belt
390 Printer electronics board
392 Cable connectors
400 Provide fluid ejector
405 Provide fluid to chamber
410 Eject fluid drop

The invention claimed is:

1. A fluid ejector comprising:

a substrate, first portions of the substrate defining an outer boundary of a cavity and second portions of the substrate defining a fluidic feed;

a MEMS transducing member, a first portion of the MEMS transducing member being anchored to the substrate, a second portion of the MEMS transducing member extending over at least a portion of the cavity, the second portion of the MEMS transducing member being free to move relative to the cavity;

a compliant membrane positioned in contact with the MEMS transducing member, a first portion of the compliant membrane covering the MEMS transducing member, and a second portion of the compliant membrane being anchored to the substrate;

partitioning walls defining a chamber that is fluidically connected to the fluidic feed, wherein at least the second portion of the MEMS transducing member is enclosed within the chamber; and a nozzle disposed proximate to the second portion of the MEMS transducing member and distal to the fluidic feed, wherein the compliant membrane does not extend over the fluidic feed.

2. The fluid ejector of claim 1, wherein the compliant membrane is anchored to the substrate around the outer boundary of the cavity.

3. The fluid ejector of claim 2, wherein the fluidic feed is not fluidically connected to the cavity.

4. The fluid ejector of claim 1, the MEMS transducing member comprising a beam having a first end and a second end, wherein the first end is anchored to the substrate and the second end cantilevers over the cavity.

5. The fluid ejector of claim 4, the beam including a first width at its first end and a second width at its second end, wherein the first width is greater than the second width.

6. The fluid ejector of claim 5, the MEMS transducing member being the first of a plurality of MEMS transducing members each comprising a beam having a first end and a second end, the first end of each of the plurality of MEMS transducing members being anchored to the substrate, and the second end of each of the plurality of MEMS transducing members being cantilevered over the cavity.

7. The fluid ejector of claim 6, each of the plurality of MEMS transducing members including a first width at its first end and a second width at its second end, wherein the first widths of a group of the plurality of MEMS transducing members are all substantially equal.

8. The fluid ejector of claim 7, wherein the second widths of a group of the plurality of MEMS transducing members are all substantially equal.

9. The fluid ejector of claim 1, wherein the outer boundary of the cavity is circular.

10. The fluid ejector of claim 1, wherein a shape of the cavity is substantially cylindrical.

11. The fluid ejector of claim 1, the MEMS transducing member and the compliant membrane being freely movable into and out of the cavity.

12. The fluid ejector of claim 1 further comprising an insulating layer being disposed in contact with the MEMS transducing member.

13. The fluid ejector of claim 12, the MEMS transducing member having a thickness $t_1$ and the insulating layer having a thickness $t_2$, wherein $t_2>0.5\ t_1$ and $t_2<2t_1$.

14. The fluid ejector of claim 1, wherein the MEMS transducing member comprises a thermally bending bimorph.

15. The fluid ejector of claim 14, the thermally bending bimorph comprising titanium aluminide.

16. The fluid ejector of claim 15, the thermally bending bimorph further comprising silicon oxide.

17. The fluid ejector of claim 1, wherein the MEMS transducing member comprises a shape memory alloy.

18. The fluid ejector of claim 17, wherein the shape memory alloy comprises a nickel titanium alloy.

19. The fluid ejector of claim 1, wherein the MEMS transducing member comprises a piezoelectric material.

20. The fluid ejector of claim 19, wherein the piezoelectric material comprises a piezoelectric ceramic.

21. The fluid ejector of claim 20, wherein the piezoelectric ceramic comprises lead zirconate titanate.

22. The fluid ejector of claim 1, wherein the compliant membrane comprises a polymer.

23. The fluid ejector of claim 22, wherein the polymer comprises an epoxy.

24. The fluid ejector of claim 1, the MEMS transducing member having a first Young's modulus and the compliant membrane having a second Young's modulus, wherein the first Young's modulus is at least 10 times greater than the second Young's modulus.

25. An inkjet printhead comprising:

a fluid ejector comprising:

a substrate, first portions of the substrate defining an outer boundary of a cavity and second portions of the substrate defining a fluidic feed;

a MEMS transducing member, a first portion of the MEMS transducing member being anchored to the substrate, a second portion of the MEMS transducing member extending over at least a portion of the cavity, the second portion of the MEMS transducing member being free to move relative to the cavity;

a compliant membrane positioned in contact with the MEMS transducing member, a first portion of the compliant membrane covering the MEMS transducing member, and a second portion of the compliant membrane being anchored to the substrate;

partitioning walls defining a chamber that is fluidically connected to the fluidic feed, wherein at least the second portion of the MEMS transducing member is enclosed within the chamber; and a nozzle disposed proximate to the second portion of the MEMS transducing member and distal to the fluidic feed, wherein the compliant membrane does not extend over the fluidic feed;

a mounting member comprising an ink passageway, the ink passageway being fluidically connected to the fluidic feed; and a sealing member configured to seal around the fluidic feed and the ink passageway.

26. The inkjet printhead of claim 25, the fluid ejector being one of a first plurality of fluid ejectors, the first plurality of fluid ejectors being fluidically connected to a first fluidic feed.

27. The inkjet printhead of claim 26, the ink passageway being a first ink passageway, the mounting member further comprising a second ink passageway, the inkjet printhead further comprising:

a second fluidic feed;

a second plurality of fluid ejectors, the second plurality of fluid ejectors being fluidically connected to the second fluidic feed, wherein the sealing member is further configured to seal around the second fluidic feed and the second ink passageway.

28. An inkjet printer comprising:

a media advance region including an input region, a printing region and an output region;

an inkjet printhead comprising:

a fluid ejector comprising:

a substrate, first portions of the substrate defining an outer boundary of a cavity and second portions of the substrate defining a fluidic feed;

a MEMS transducing member, a first portion of the MEMS transducing member being anchored to the substrate, a second portion of the MEMS transducing member extending over at least a portion of the cavity, the second portion of the MEMS transducing member being free to move relative to the cavity;

a compliant membrane positioned in contact with the MEMS transducing member, a first portion of the compliant membrane covering the MEMS transducing member, and a second portion of the compliant membrane being anchored to the substrate;

partitioning walls defining a chamber that is fluidically connected to the fluidic feed, wherein at least the second portion of the MEMS transducing member is enclosed within the chamber; and a nozzle disposed proximate to the second portion of the transducing member and distal to the fluidic feed, wherein the compliant membrane does not extend over the fluidic feed;

a mounting member comprising an ink passageway, the ink passageway being fluidically connected to the fluidic feed; and a sealing member configured to seal around the fluidic feed and the ink passageway;

a fluid supply fluidically connected to the ink passageway of the mounting member; and a controller configured to control the ejection of drops of fluid from the fluid ejector onto a portion of media disposed in the printing region.

29. An inkjet printhead comprising:

a fluid ejector comprising:

a substrate, first portions of the substrate defining an outer boundary of a cavity and second portions of the substrate defining a fluidic feed;

a MEMS transducing member, a first portion of the MEMS transducing member being anchored to the substrate, a second portion of the MEMS transducing member extending over at least a portion of the cavity, the second portion of the MEMS transducing member being free to move relative to the cavity;

a compliant membrane positioned in contact with the MEMS transducing member, a first portion of the compliant membrane covering the MEMS transducing member, and a second portion of the compliant membrane being anchored to the substrate;

partitioning walls defining a chamber that is fluidically connected to the fluidic feed, wherein at least the second portion of the MEMS transducing member is enclosed within the chamber; and a nozzle disposed proximate to the second portion of the MEMS transducing member and distal to the fluidic feed;

a mounting member comprising an ink passageway, the ink passageway being fluidically connected to the fluidic feed; and a sealing member configured to seal around the fluidic feed and the ink passageway, the fluid ejector being one of a first plurality of fluid ejectors, the first plurality of fluid ejectors being fluidically connected to a first fluidic feed.

30. The inkjet printhead of claim 29, the ink passageway being a first ink passageway, the mounting member further comprising a second ink passageway, the inkjet printhead further comprising:

a second fluidic feed;

a second plurality of fluid ejectors, the second plurality of fluid ejectors being fluidically connected to the second fluidic feed, wherein the sealing member is further configured to seal around the second fluidic feed and the second ink passageway.

31. A fluid ejector comprising:

a substrate, first portions of the substrate defining an outer boundary of a cavity and second portions of the substrate defining a fluidic feed;

a plurality of MEMS transducing members, a first portion of each of the plurality of MEMS transducing members being anchored to the substrate, a second portion of each of the plurality of MEMS transducing member extending over at least a portion of the cavity, the second portion of each of the plurality of MEMS transducing members being free to move relative to the cavity;

a compliant membrane positioned in contact with the plurality of MEMS transducing members, a first portion of the compliant membrane covering the plurality of MEMS transducing members, and a second portion of the compliant membrane being anchored to the substrate;

partitioning walls defining a chamber that is fluidically connected to the fluidic feed, wherein at least the second portion of each of the plurality of MEMS transducing members is enclosed within the chamber; and a nozzle plate that is formed over the partitioning walls.

32. The fluid ejector of claim 31, the first portion of a group of the plurality of MEMS transducing members including a first width, the second portion of the group of the plurality of MEMS transducing members including a second width, wherein the first width is greater than the second width.

33. The fluid ejector of claim 31, the first portion of a group of the plurality of MEMS transducing members including a first width, the second portion of the group of the plurality of MEMS transducing members including a second width, wherein the first widths of the group of the plurality of MEMS transducing members are substantially equal.

34. The fluid ejector of claim 33, wherein the second widths of the group of the plurality of MEMS transducing members are substantially equal.

* * * * *